US012270222B2

(12) United States Patent
Maynard

(10) Patent No.: US 12,270,222 B2
(45) Date of Patent: Apr. 8, 2025

(54) HOT TUB COVER HOIST MECHANISM

(71) Applicant: Shawn Michael Maynard, North Ogden, UT (US)

(72) Inventor: Shawn Michael Maynard, North Ogden, UT (US)

( * ) Notice: Subject to any disclaimer, the term of this patent is extended or adjusted under 35 U.S.C. 154(b) by 0 days.

(21) Appl. No.: 18/787,465

(22) Filed: Jul. 29, 2024

(65) Prior Publication Data

US 2024/0384551 A1 Nov. 21, 2024

Related U.S. Application Data

(63) Continuation-in-part of application No. 16/926,430, filed on Jul. 10, 2020, now abandoned.

(51) Int. Cl.
*E04H 4/08* (2006.01)

(52) U.S. Cl.
CPC ..... *E04H 4/084* (2013.01)

(58) Field of Classification Search
CPC ..... E04H 4/084; E04H 4/065; A63C 19/12; B66D 3/20; B66D 3/26; B66D 1/60; B66D 1/12; B66D 1/00; A63J 1/028; B66F 7/02; B66F 7/00
See application file for complete search history.

(56) References Cited

U.S. PATENT DOCUMENTS

| | | | | |
|---|---|---|---|---|
| 3,241,157 | A | 3/1966 | Baker et al. | |
| 3,895,400 | A * | 7/1975 | Kelcey | E04H 3/165 4/503 |
| 4,006,567 | A | 2/1977 | Flannery | |
| 4,165,543 | A * | 8/1979 | Reinert | E04H 4/084 4/500 |
| 4,598,506 | A * | 7/1986 | Nohl | E04H 4/084 254/387 |
| 6,122,925 | A * | 9/2000 | Rawlins | A63C 19/12 62/235 |
| 7,108,566 | B2 | 9/2006 | Kressmann et al. | |
| 7,575,098 | B2 * | 8/2009 | Hartley | B66B 9/00 248/330.1 |
| 7,766,755 | B2 * | 8/2010 | Werner | E04H 15/58 472/126 |
| 8,421,962 | B2 | 4/2013 | Ishitobi et al. | |
| 9,572,427 | B2 | 8/2017 | Klooth | |
| 2004/0052582 | A1 * | 3/2004 | Becker | B66F 7/00 114/44 |
| 2007/0017017 | A1 | 1/2007 | Piche et al. | |
| 2009/0049595 | A1 * | 2/2009 | Muller | E04H 4/084 4/500 |
| 2011/0042634 | A1 * | 2/2011 | Boychuk | B66D 1/12 254/362 |
| 2017/0224105 | A1 | 2/2017 | Klooth | |

FOREIGN PATENT DOCUMENTS

| | | | |
|---|---|---|---|
| DE | 102007041367 | A1 | 3/2009 |
| WO | 0114678 | A1 | 3/2001 |

* cited by examiner

*Primary Examiner* — Theodore V Adamos
(74) *Attorney, Agent, or Firm* — Berggren Law Offices, LLC

(57) ABSTRACT

A hot tub cover hoist mechanism for lifting the rigid cover of a hot tub to the ceiling of the structure above. The hot tub cover hoist mechanism includes an overhead mechanism, at least a pair of shafts, a cable system, a direct force lifting mechanism, a rigid cover, and a tensioning mechanism. The hot tub cover hoist mechanism works by rotating the shafts simultaneously to raise and lower the hot tub rigid cover as desired.

18 Claims, 19 Drawing Sheets

HOT TUB COVER HOIST MECHANISM

FIELD OF THE INVENTION

This invention relates to a mechanism for raising the cover of large a container, particularly the cover of a hot tub toward the ceiling of a structure above it and lowering the cover to cover the large container.

BACKGROUND OF THE INVENTION

Traditional spa/swim spa covers can be heavy and difficult to remove. In addition, traditional cover lifter options keep the cover attached to the spa, either taking up space or blocking access from one or more sides.

There are currently two solutions to this problem. One solution utilizes traditional hot tub cover lifters that use an arm bracket solution to fold the foam/vinyl cover over the arm and store the cover vertically on either one end of the spa or two ends of the larger swim spa. This makes it possible for one person to remove the cover but is not the best solution. It blocks access to the spa from one side, and is still difficult for some to operate, especially for larger or taller swim spas or when the user is shorter and if they are not strong.

A second solution is a hot tub cover as described in U.S. Pat. No. 6,718,566. It utilizes a structure consisting of four telescoping motorized legs that lift the cover four to five feet above the spa or swim spa. This solution is easy to use, but is expensive, not appropriate for use when there is a structure above the spa or swim spa, and the supporting leg structures limit access to the spa with the leg structures.

There is still a need for a hot tub cover hoist mechanism that lifts the cover off a spa or swim spa, does not restrict access to the spa or swim spa, and works for spas and swim spas that have a structure above the spa or swim spa tub.

SUMMARY OF THE INVENTION

The current invention is a spa or swim spa cover hoist mechanism that is specifically designed for use when the spa is installed in a room or under a roof or other structure. It requires no effort to lift as the lift is powered by a motor and only requires the user to turn the key to lift the rigid cover. When in use the rigid cover raises toward the ceiling over the spa or swim spa allowing full access to all sides of the spa and fits in spaces where other options require extra clearance on the sides. As used herein, hot tubs are equivalent to both spas and larger swim spas.

In this respect, before explaining at least one embodiment of the cover hoist mechanism in detail, it is to be understood that the cover hoist mechanism is not limited in its application to the details of construction or to the arrangements of the components set forth in the following description or illustrated in the drawings. The cover hoist mechanism is capable of other embodiments and of being practiced and conducted in several ways. Also, it is to be understood that the phraseology and terminology employed herein are for the purpose of the description and should not be regarded as limiting.

The hot tub cover mechanism comprises an article aspect and a method aspect. The article aspect comprises five elements, an overhead mechanism, a system of cables, a direct drive lifting mechanism, a rigid cover, and a cable-tensioning mechanism attached to each cable. First the overhead mechanism is configured to attach to a ceiling structure above a hot tub. The overhead mechanism comprises housings with shafts comprising at least a first housing comprising a first shaft with a first end region and a second end region, and a second housing with a second shaft with a first end region and a second end region. Second, the system of cables comprises cables that comprise at least four cables with first cable ends and second cable ends where each cable comprises a body that extends vertically downward and the four cables, first cable ends, and second cable ends comprise (1) a first cable having a first cable end attached to the first end region of the first shaft and a second cable end attached to a rigid cover, (2) a second cable having a first cable end attached to the second end region of the first shaft and a second cable end attached to the rigid cover, (3) a third cable having a first cable end attached to the first end region of the second shaft and a second cable end attached to the rigid cover, and (4) a fourth cable having a first cable end attached to the second end region of the second shaft and a second cable end attached the rigid cover. Third, the lifting mechanism within the overhead mechanism comprises a direct drive lift in communication with at least the first shaft and the second shaft. The lifting mechanism (1) is in communication with the first cable ends, (2) is configured to exert a vertical first force from the direct drive lift through the four cables, and (3) is configured to turn the first shaft and the second shaft to rotate the first shaft and the second shaft in a first direction and a second direction in synchronized movement to lift the second ends in unison. Fourth, the rigid cover has a weight with a vertical second force that is not more than the vertical first force from the direct drive lift through the cables. It is in communication with the second ends of the cables, and comprises (1) a first edge with a first end region attached to the second cable end of the first cable and a second end region attached to the second cable end of the second cable and (2) a second edge parallel to the first edge and with a first end region attached to the second cable end of the third cable and a second end region attached to the second cable end of the fourth cable that is configured to distribute the weight and vertical second force of the rigid cover equally when the cables are under tension. Fifth, the cable-tensioning mechanism is attached to each cable and is configured to maintain each cable under tension when the rigid hot tub cover is resting on the hot tub.

The method aspect of operating step includes five steps. One step is to provide a hot tub under a structure with a ceiling. Another step is to provide a hot tub cover hoist mechanism comprising the four elements described above. Still another step is to affix the hot tub hoist mechanism to the ceiling and to the rigid cover. Another step is activating the direct drive lifting mechanism to turn the shafts to raise the rigid cover toward the ceiling to permit use of the hot tub. Still another is activating the direct drive lifting mechanism to turn the shafts to lower the rigid cover onto the hot tub when finished using the hot tub.

The cover hoist mechanism of the invention and its embodiments has at least six benefits over the current art. First, the invention provides a cover hoist mechanism for lifting the cover of a hot tub to the ceiling of the structure above. Second, it provides a cover hoist mechanism that quickly and easily lifts the hot tub cover to the roof of the structure above. With assistance from the cover hoist little or no physical ability is required. Third, it provides a way to lift and store a hot tub cover that leaves all sides of the hot tub free from attachment thus providing access to all sides of the hot tub. Fourth, it provides a cover hoist mechanism that when the hot tub is open allows views in and out of the hot tub from all directions. Fifth, some embodiments offer a safe secure latching mechanism to keep the cover safely latched in place when not in use. Sixth, each cable is attached to a cable-tensioning mechanism to prevent cable slack from occurring when the rigid hot tub cover is lowered to a resting position on the hot tub. Other objects and advantages of the various embodiments of the present invention will become obvious to the reader and it is intended that these objects and advantages are within the scope of the present invention.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

FIG. 13 is a side perspective view of two versions of a rigid cover latch in a locked and unlocked position.

FIG. 17 is a front view of a mechanism to keep tension on each cable attached to the rigid cover.

Figure 1:
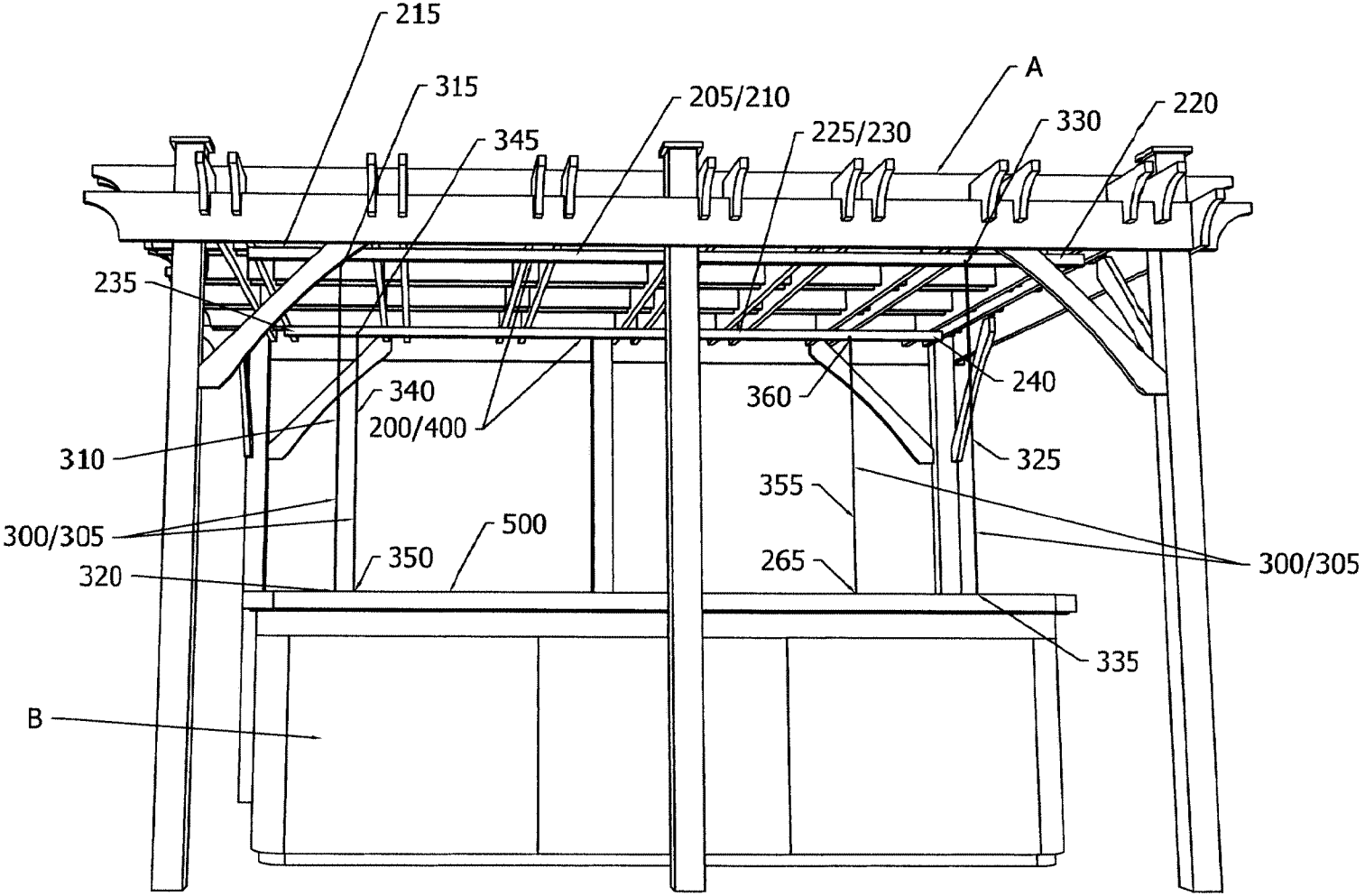
FIG. 1 is a side view of one embodiment of a hot tub cover hoist mechanism installed on a pergola with a hot tub below and the lift mechanism is a direct drive lift.

The above drawings are illustrative only, and changes may be made in the specific construction illustrated and described within the scope of this application. While the invention is amenable to various modifications and alternative forms, specifics thereof have been shown by way of example in the drawings and will be described in detail below. It is to be understood, however, that the intention is not to limit the invention to the embodiments described. On the contrary, the invention is intended to cover all modifications, equivalents, and alternatives falling within the scope of the invention as defined by the appended claims.

DETAILED DESCRIPTION OF SOME EMBODIMENTS OF THE INVENTION

The hot tub cover mechanism comprises an article aspect and a method aspect. The article aspect comprises five elements, an overhead mechanism, a system of cables, a direct drive lifting mechanism, a rigid cover, and a cable-tensioning mechanism.

The overhead mechanism comprises a first housing comprising housings with shafts comprising at least a first shaft with a first end region and a second end region, and a second housing with a second shaft with a first end region and a second end region. The overhead mechanism is configured to attach to a variety of ceilings or structures above a hot tub. Such structures include, for example, the ceiling of a room that contains a hot tub, or under a roof or other structure built over the hot tub. The invention does not include the ceiling but is used where there is one. The shaft may be hollow or solid and is made of material that is hard and strong enough to withstand the forces placed on it when used to lift the rigid cover.

The system of cables comprises cables that comprise at least four cables with first cable ends and second cable ends where each cable comprises a body that extends vertically downward and the four cables, first cable ends, and second cable ends comprise the following. A first cable has a first cable end attached to the first end region of the first shaft and a second cable end attached to a rigid cove. A second cable has a first cable end attached to the second end region of the first shaft and a second cable end attached to the rigid cover. A third cable has a first cable end attached to the first end region of the second shaft and a second cable end attached to the rigid cover. A fourth cable has a first cable end attached to the second end region of the second shaft and a second cable end attached to the rigid cover.

The lifting mechanism within the overhead mechanism comprises a direct drive lift in communication with at least the first shaft and the second shaft. The lifting mechanism is in communication with the first cable ends. It is configured to exert a first force from the direct drive lift through the cables. It is also configured to turn the first shaft and the second shaft to rotate in synchronized movement the first shaft and the second shaft in a first direction and a second direction to lift and lower the second ends in unison.

The direct drive lifting mechanism was found to be the most suitable for the invention of the three approaches considered, direct drive mechanism, counterweight mechanism, and spring lift mechanism. The counterweight mechanism allowed for the cable to slip which was thought to be an advantage because it kept the cables tight. However, it turned out to be a negative because it was not dependable. The spring lift mechanism looked clunky and seemed dangerous with the spring load. The direct drive lifting mechanism was the most dependable and easiest to install and service.

In some embodiments, the means of turning the shaft in each housing is a tubular motor as shown in FIG. 1 to FIG. 6.

Figure 7:
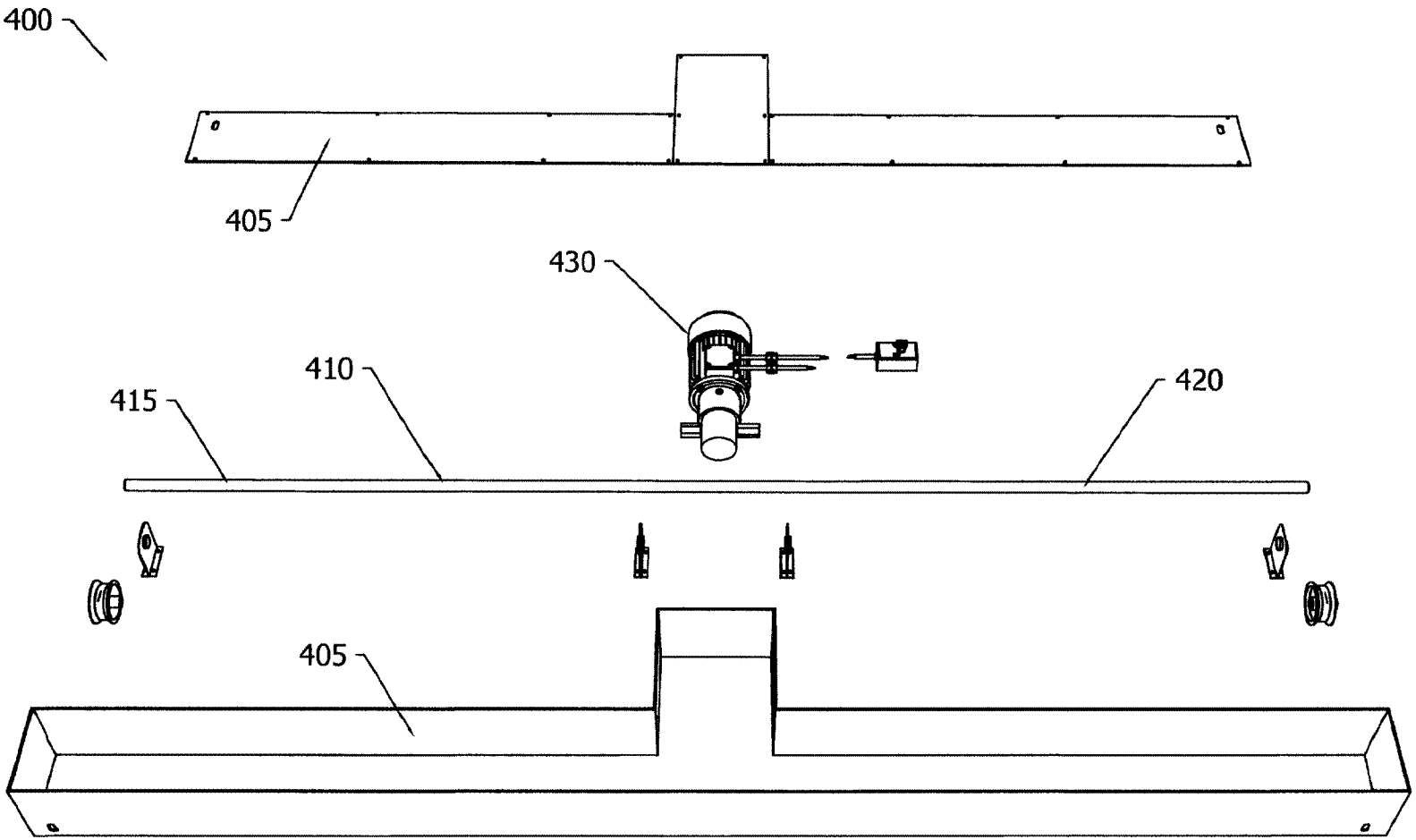
FIG. 7 is a top exploded perspective view of an embodiment of the hot tub cover hoist mechanism showing a means for turning the shaft, a shaft drive motor.

In some embodiments, the means of turning the shaft in each housing is a shaft drive motor as shown in FIG. 7.

Figure 8:
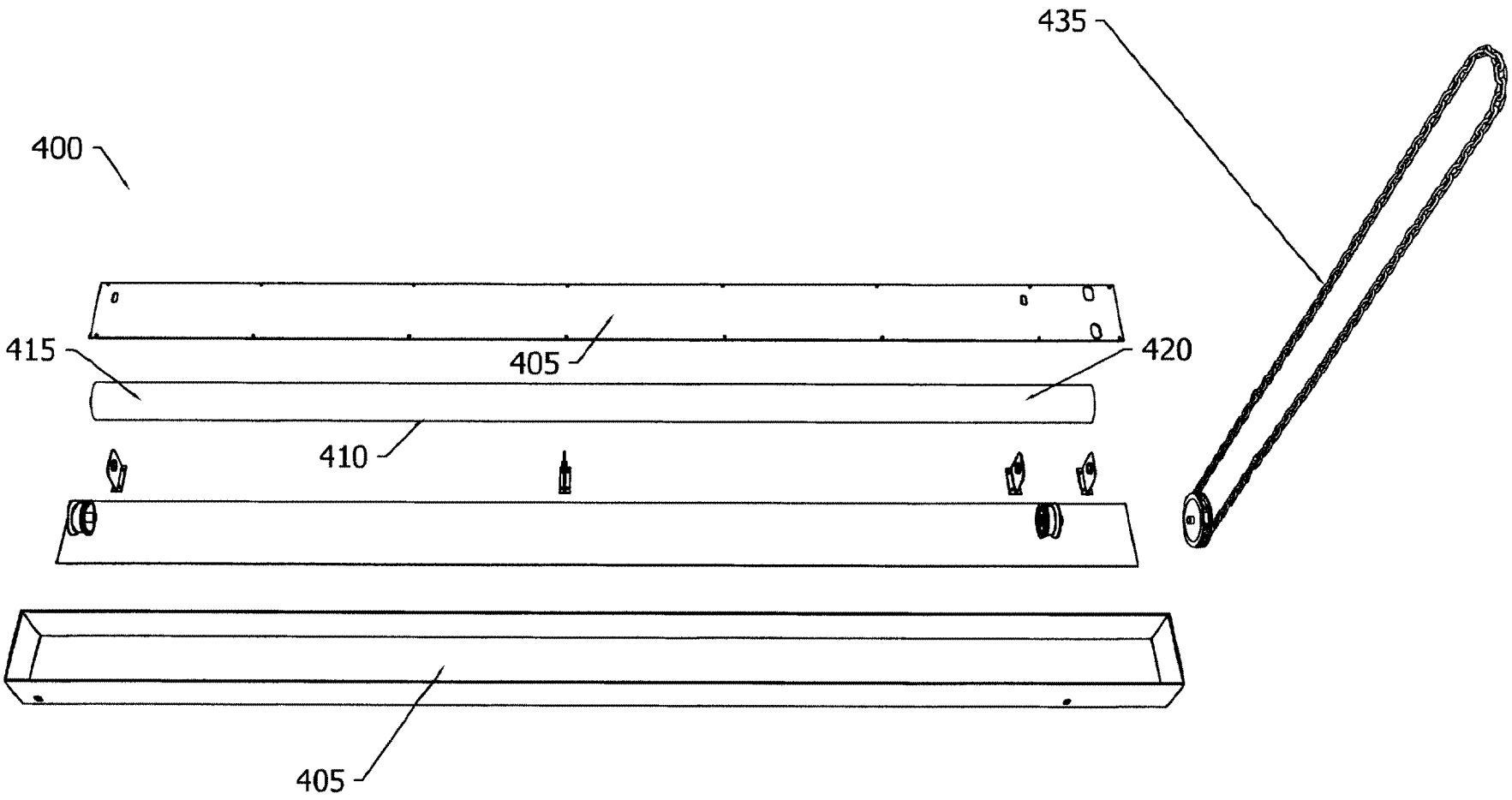
FIG. 8 is an exploded perspective view looking downward of an embodiment of the hot tub cover hoist mechanism showing only the holder, shaft, and the means for turning the shaft, a pull chain drive assembly.

In some embodiments, the means of turning the shaft in each housing is a pull chain drive assembly as shown in FIG. 8. The rigid cover has a weight with a vertical second force that is not more than the first force from the direct drive lift through the cables. It is in communication with the second ends of the cables, The rigid roof comprises a first edge with a first end region attached to the second cable end of the first cable and a second end region attached to the second cable end of the second cable. The rigid roof also comprises a second edge parallel to the first edge and with a first end region attached to the second cable end of the third cable and a second end region attached to the second cable end of the fourth cable that is configured to distribute the weight and vertical second force of the rigid cover equally when the cables are under tension.

It is important that the rigid cover be rigid enough to be a flat horizontal sheet that can be above the hot tub and lowered onto the hot tub repeatedly. Satisfactory performance may entail the performance persist for a long time, extending into months and years. Smaller hot tubs may have factory covers that are rigid enough to be stable under continued use attached to the second ends of cables under tension for hours at a time. The second ends of the cable are typically affixed to the rigid cover on opposite sides of often the longer edge at distances and apart from center to spread the weight evenly, such as the end regions.

In some embodiments, a frame is affixed around the edges of the factory cover to make it satisfactorily rigid and provide points of contact for the cable send ends. The frame is typically made of rigid shaft or channel attached to the factory cover. The factory cover often comes in 2 to 6 pieces custom sized for each factory cover and is meant to fold. The factory cover needs to be framed into one rigid piece to lift the rigid cover without it being "floppy". Some covers have sewn into them a pocket that could accept the shaft, most will require the shaft to be attached to the cover using webbing. The framework could be made of galvanized, aluminum, or plastic channel, square angle, or round shaft. The mechanism for attaching the shaft may use nylon webbing and plastic buckles. But it could be attached with other methods, such as modifying the existing cover and sliding the shaft into the existing cover fabric or attaching the shaft to the fabric of the cover with ties or similar connectors.

In some embodiments, a rigid cover is made from insulated panels to replace the factory cover. A rigid cover using panels and connectors could be included with the hot tub cover hoisting mechanism to provide a long-lasting energy efficient rigid cover. This cover could be assembled into one rigid cover eliminating the need for an additional frame. The sandwich panels could be made with expanded polystyrene or extruded polystyrene foam, honeycomb foams, or other similar materials. The skin of the panel could be of metal, fiberglass, plastic, or other similar materials. The panels could be made of extruded vinyl or plastic instead of sandwich panels. The frame could be extruded aluminum but could also be plastic or metal. The connector strips would be those conventionally used with such panels.

In some embodiments, rigid cover may be a cover made of drop stitch fabric sewn to the size of the hot tub. The drop stitch cover would arrive in a small compact package and be inflated on site. It may or may not have a frame around the perimeter depending on the rigidity and size of this cover.

The cable-tensioning mechanism is attached to each cable and configured to maintain each cable under tension when the rigid hot tub cover is resting on the hot tub, each cable is configured to have not more than a few inches of slack when the rigid hot tub cover is resting on the hot tub. The cable-tensioning mechanism is attached to an end of each cable to eliminate any clack in the cable that may occur when the hot tub cover is at rest on the hot tub. Slack, if sufficient, may result in cable slipping from its spool or drum that is attached to a shaft.

Two mechanisms may be used to keep tension of the cables and assure simultaneous lifting and lowering of the rigid cover.

Figure 15:
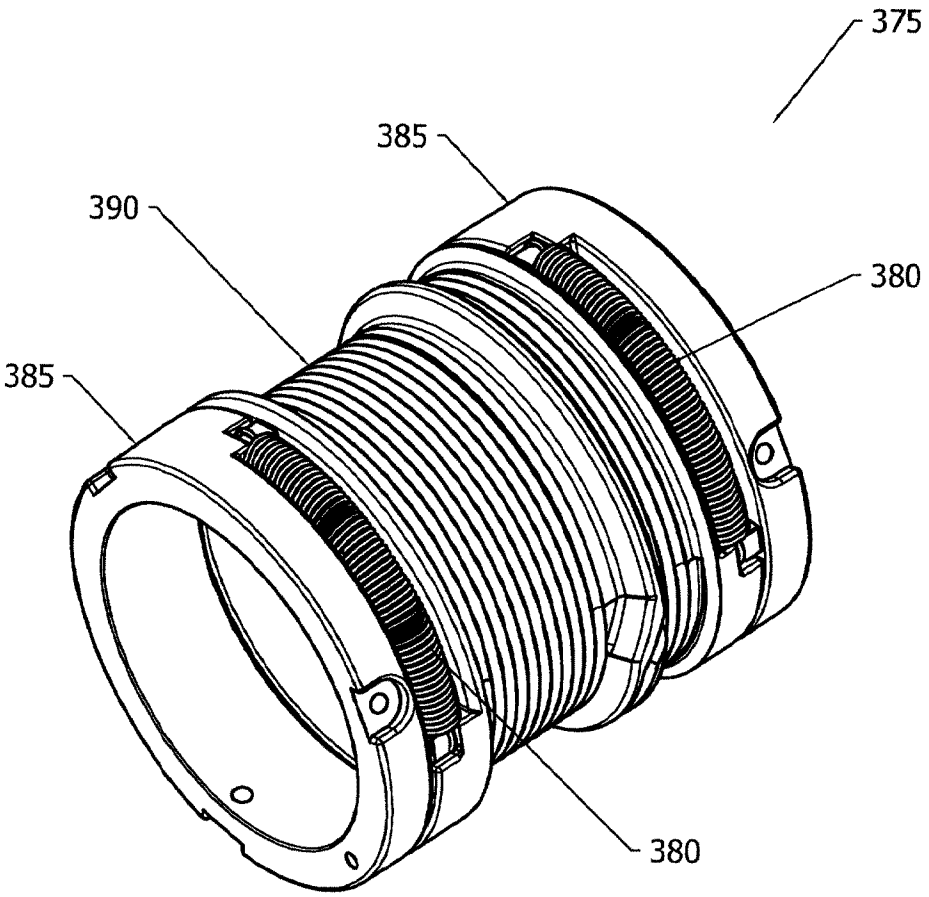
FIG. 15 is a perspective view of a mechanism to keep tension on each cable attached to each shaft.
Figure 16:
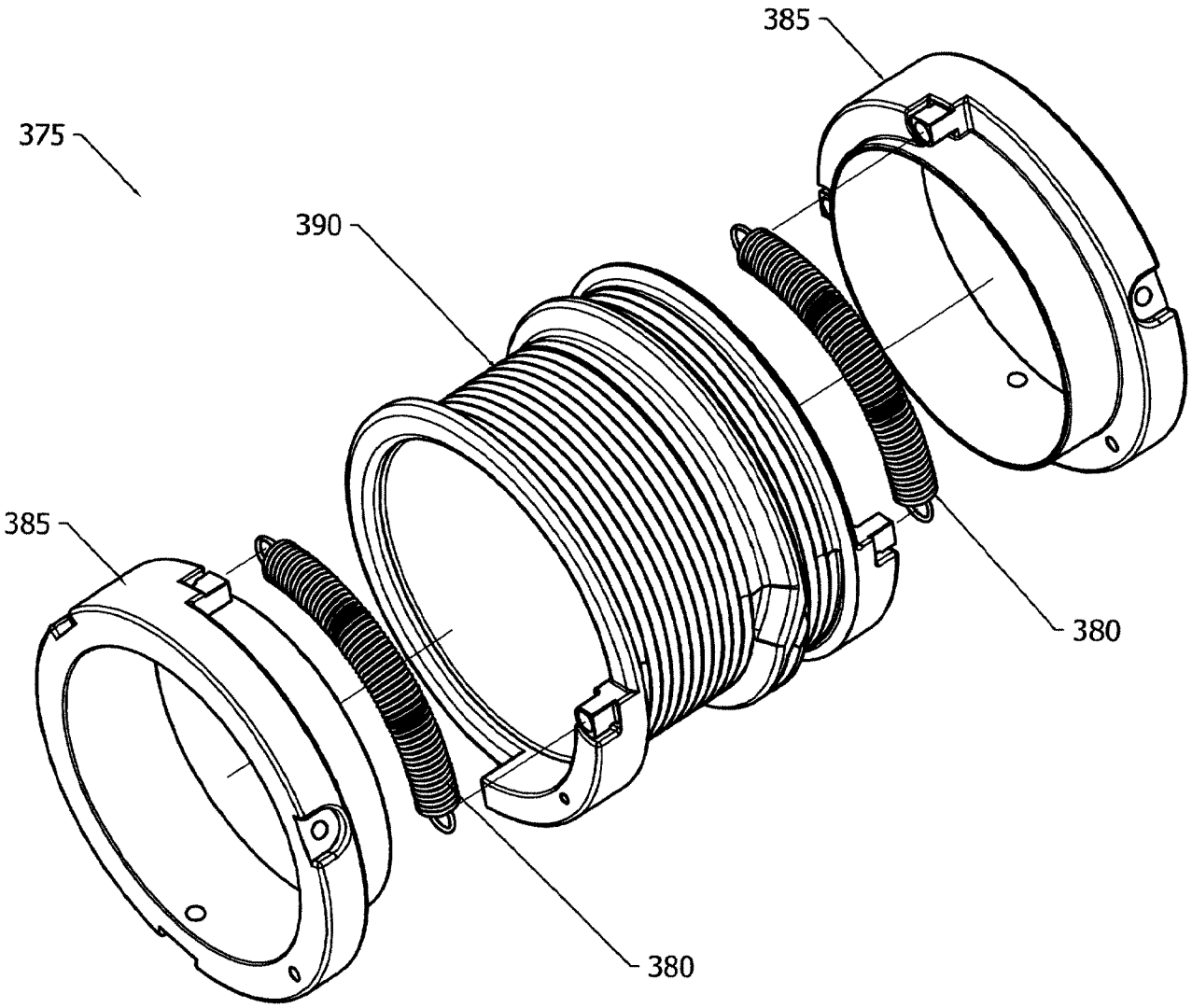
FIG. 16 is an exploded perspective view of a mechanism to keep tension on the cable attached to each shaft.

In one embodiment, the cable-tensioning mechanism is attached to each corner of the two shafts. This mechanism is shown in FIG. 15 and FIG. 16. The Drum that holds the cable is made up of 3 parts-two outer parts secured to the rotating tube. with the middle part sandwiched between the two outer rings. The center portion is formed with molded grooves to direct the accumulation of the cable. The center section of the drum keys into the two outer rings with the ability to rotate about ¼ turn-up to 4". The center section is attached to the outer rings with extension springs that extend when the hot tub rigid cover is lifted. When the hot tub rigid cover is lowered and the weight of the hot tub rigid cover is parked on the hot tub the springs pull the center drum component to remove the slack in the cable, thus preventing a "birdsnest" of unspooling of the cable. This is beneficial when the cable length between shaft and rigid hot tub cover is greater than the length between the shaft and the rigid hot cub cover. Sometime the difference may be a few inches that is enough to permit the cable in question to fall out of its spool or drum on the cable.

In another embodiment, the cable-tensioning mechanism is attached to the rigid cover. This mechanism shown in FIG. 17 consists of a pulley to redirect the direction of cable travel 90 degrees from downward so the cable travels along the perimeter of the cover. The cable then connects to a spring. When lifted the spring is extended and hits a stop that then lifts the cover. When lowered the cover will rest on the spa and the spring will continue to pull the cable for some length, such as for example up to 3 inches, to maintain tension on the cable keeping the cable tight. This avoids a "birdsnest" unspooling of the cable.

Figure 19:
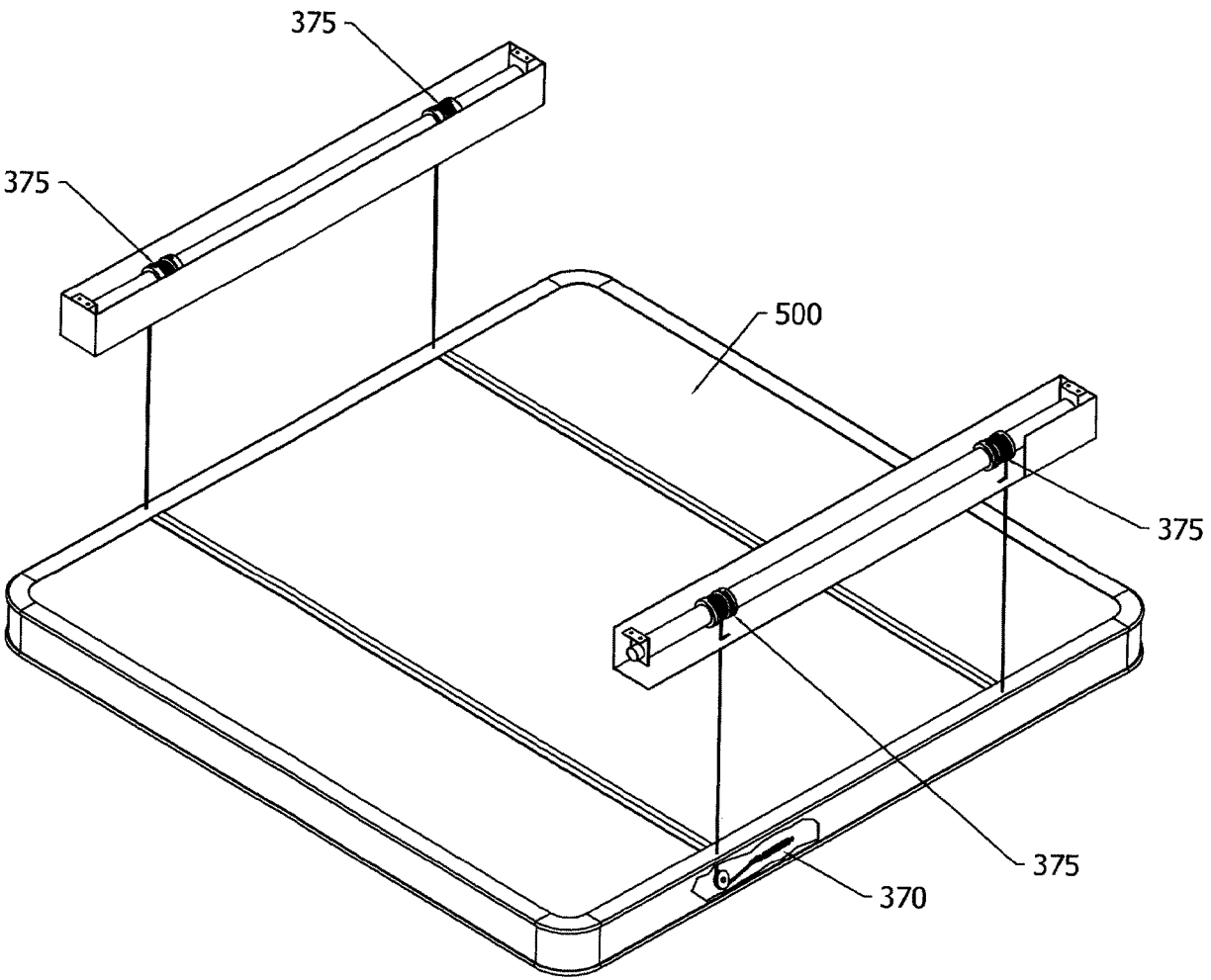
FIG. 19 is a perspective view looking downward on an embodiment of the hot tub cover hoist mechanism showing the cable tension mechanisms attached to the direct drive shafts as well as the tension mechanism attached to the rigid cover.

FIG. 19 shows the device shown in FIG. 15 and FIG. 16 attached to the shafts and the device shown in FIG. 17 attached to the rigid cover.

The lift mechanism of the hot tub hoist mechanism turns the shaft with brute force to lift the rigid cover using a direct drive lift. Throughout this document, lift mechanism and direct drive lift are used interchangeably. The first force is created by the shaft rotating to collect the cables attached to the rigid cover, the source of the second force. The motor turning the shaft creates the first force with the first cable ends attached to the shaft and wound or unwound upon it as the rigid cover is raised or lowered. This type also results in no cables in horizontal view of occupants in the hot tub unlike when using a counterweight lift mechanism.

The force needed to wind the cables onto a shaft to lift and lower a rigid cover can be large as the rigid covers increase in weight as the length of the spa increases. One way to reduce the size of the motor is to use two motors, one on each side of the rigid cover, in the case of larger hot tubs such as swim tubs. One way is to use two motors to rotate two shafts, a first shaft and a second shaft, in two housings, a first and a second, respectively. In one embodiment, the first housing and the second housing may be affixed to the ceiling of the structure above opposite first and second edges, typically the longer edges, of the hot tub cover. At least two first ends of the first cables are affixed to the first shaft above the first rigid cover edge on at least two locations and at least two of the second ends of the first cables are affixed at in equal spaces about a center point of the first edge of the rigid cover. Similarly, at least two first ends of the second cable are affixed to the second shaft above the second rigid cover edge on at least two locations and at least two of the second ends of the second cables are affixed at in equal spaces about a center point of the second edge of the rigid cover. The number of cables used on each side of the hot tub are the same. Also, typically two cables are used on each side, but more may be desired, particularly with larger rigid covers.

In all cases there is a motor used to pull the four (or more) cables and lift the rigid cover. The motor is controlled by a simple on/off switch which may be wired or remote and wirelessly controlled. The motors or the control mechanism may have limits which will limit the travel of the motor when lifting or lowering the rigid cover. One motor may rotate both shafts or one motor may be used to rotate each shaft. In the latter case that motor may be a tubular motor or a shaft motor assembly that is on one end of the shaft and internal to the shaft or a pull chain motor or drive assembly. The assembly drives the rotation of the shaft. The shaft length can vary, and the assembly can also be extended with pass through drive connectors and additional tubes and hangers. The cables are wound up on the shaft as the rigid cover is lifted. Spools may be used to contain and guide the wires while they are wound up.

More than a single motor may be used in some embodiments. For example, four separate moors motors or wind-up drums may be installed with one at each corner of two shafts to operate together in unison. This may be required due to ceiling configuration.

Latches may be used to provide security to the hot tub when not in use. Once the rigid cover sits on the spa, a latching mechanism may be used to secure the rigid cover. This mechanism will disengage when the rigid cover is lifted. The mechanism may be operated by use of shocks, springs, servo motors and other mechanical means. The latches will help to secure the rigid cover against unintentional access or removal by other forces such as wind. The example shown in FIG. 13 is of two variations, but other variations and designs of the latch may be used to accomplish the same result. Part of the latching mechanism would be an alignment or guide fixture which would assist in locating the rigid cover in the correct location for effective latching to occur.

Powered accessories may also be employed to obtain additional features with the hot tub.

Power and/or control wires may be supplied to the rigid cover through a similar mechanism as used with the lifting cables. Power in the rigid cover allows for items such as lights, speakers, controls, and motors for operating mechanisms.

Figure 18:
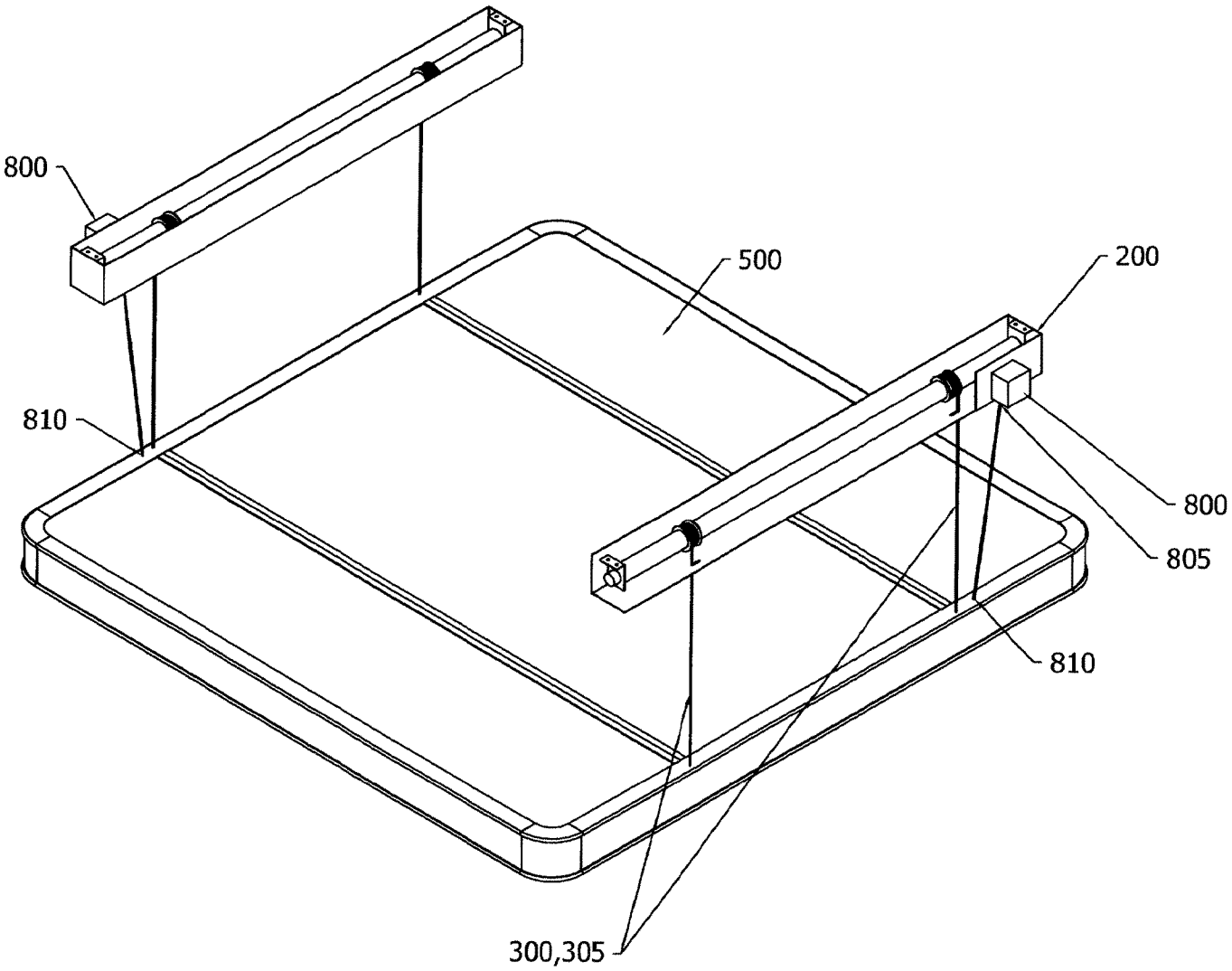
FIG. 18 is a perspective view looking downward on an embodiment of the hot tub cover hoist mechanism containing an accessory device direct drive lifting mechanism for a spa showing two housings, each with cables directed downward to opposite sides of a rigid cover and the associated safety device to prevent accidental lowering of the rigid cover in the event of a component failure.

In some embodiments, the hot tub cover hoist mechanism comprises a safety device to prevent accidental lowering of the rigid cover in the event of a component failure. To offer a higher degree of safety a "fall protection" assembly may be added. This assembly includes a gear that rotates against a braking claw. When the gear rotates slowly as in normal operation—the braking claw ticks each gear tooth but does not catch . . . when the rotation of the gear is fast (as would happen if a component were to break) the braking tooth would catch the gear and stop the cover from falling. As shown in FIG. 18, this device is mounted to the outside of at one overhead mechanism and has a cable that is attached to the cover. When the mechanism cable is reeled out or in at a slow pace it will easily rotate or move. However, if the motion of the cable is very quick this mechanism will lock up and hold the cable tight, not allowing the cover to fall rapidly. This is similar to the function of a seat belt in an automobile. This safety feature prevents a cover from falling if any other system component such as, for example, a motor, a shaft, a wire connection, or a pulley, fails. Some embodiments may have a safety device mounted on either end of the overhead mechanism. Some embodiments may have a safety device on both overhead mechanisms. One example of this type of device is a 23 ft Self Retracting Lifeline 330 lbs. Fall Arrester with fall protection dual swivels, alloy steel hook, and flame-retardant steel wire rope from Kwik Safety, Charlotte NC, 28216.

Assembling the parts of the hot tub cover housing mechanism uses components known to the industry. The overhead mechanism is bolted to the ceiling above the hot tub structure. The motor shaft to rotate the shaft in the housing is attached to that shaft in the housing. The cables are bolted to the rigid cover frame, routed up to the spools on the motor shaft. The motor of the direct drive lift mechanisms is either attached to the shaft with set screws and bolted to the structure or the motor is installed inside of the shaft and fixed with set screws. If equipped with manual option—the chain gear is fixed to the shaft in the housing with set screws and chain loop hangs to the ground level.

The article may be further understood by means of viewing figures of some embodiments wherein like elements are represented by like reference characters. The lift mechanism and direct drive lift are used in this document and comprise powered shafts attached to a rigid cover of a hot tub or swim spa with cables that raise and lower the rigid cover as the powered shafts are rotated in one direction or the other.

FIG. 1 is a side view of one embodiment of a hot tub cover hoist mechanism installed on a pergola with a swim spa below and a lift mechanism/direct drive lift (400) is shown. Ceiling structure A is over hot tub B. A hot tub hoist mechanism (100) is shown with housing (200) comprising (1) a first housing (205) that contains a first shaft (210) with a first end region (215) and a second end region (220), and (2) a second housing (225) that contain a second shaft (230) with a first end region (235) and a second end region (240). A rigid cover (500) is shown with (1) a first edge (505) having a first end region (510) and a second end region (515) and (2) a second edge (520) having a first end region (525) and a second end region (530). A cable system (300) is shown with four cables all having similar cable bodies (205) and descending to rigid cover 500 on hot tub B. A first cable (310) is shown with a first cable end (315) affixed to first shaft 210 at first end region 215 and a second cable end (320) affixed to first end region 510 of first edge 505 of rigid cover 500. A second cable (325) is shown with a first cable end (330) affixed to first shaft 210 at second end region 220 and a second cable end (335) affixed to second end region 515 of first edge 505 of rigid cover 500. A third cable (340) is shown with a first cable end (345) affixed to second shaft 230 at first end region 235 and a second cable end (350) affixed to first end region 525 of second edge 520 of rigid cover 500. A fourth cable (355) is shown with a first cable end (360) affixed to second shaft 230 at second end region 240 and a second cable end (365) affixed to second end region 530 of second edge 520 of rigid cover 500.

Figure 2:
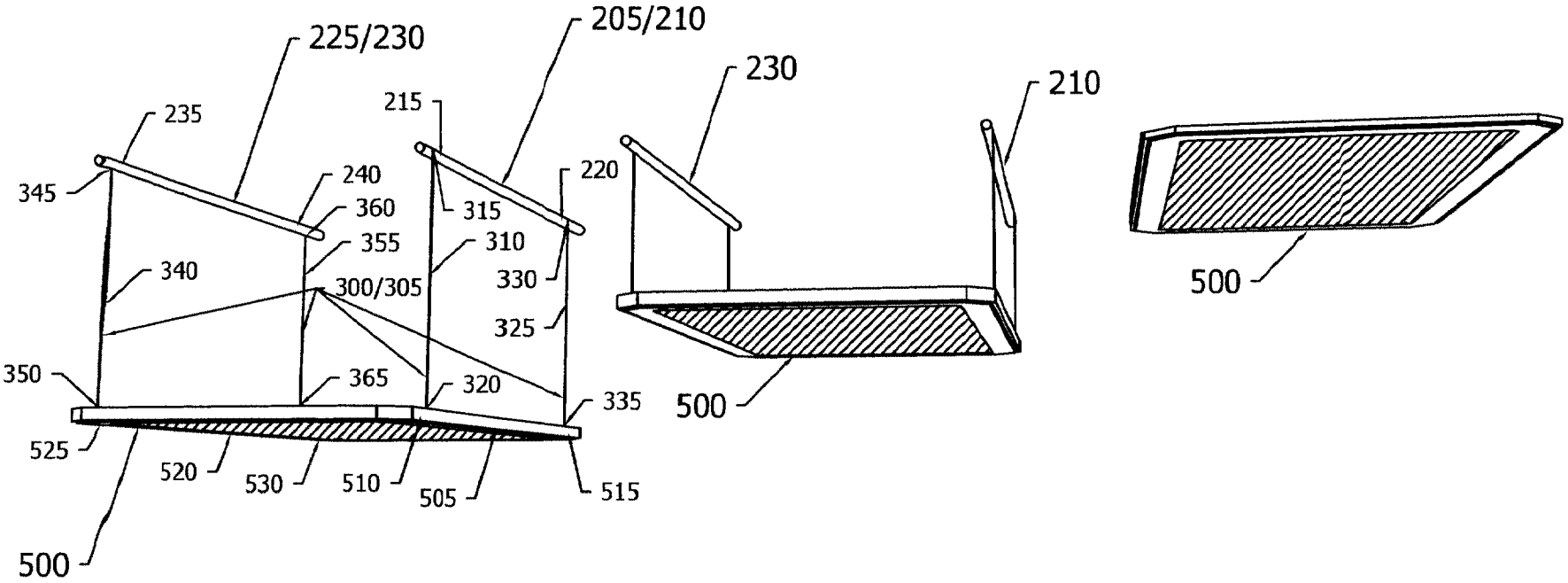
FIG. 2 is a side perspective view of an embodiment of a hot tub cover hoist mechanism including a lift mechanism/direct drive lift without an outside ceiling structure above and showing three positions of a rigid cover, lowest, mid-point and highest.

FIG. 2 is a side perspective view of an embodiment of hot tub cover hoist mechanism including lift mechanism/direct drive lift 400 without an outside ceiling structure above and showing three positions of a rigid cover, lowest, mid-point and highest. Hot tub hoist mechanism 100 is shown with first housing (205) that contains first shaft 210 with first end region 215 and second end region 220 and second housing 225 that contain second shaft 230 with first end region 235 and second end region 240. Rigid cover 500 is shown with first edge 505 having first end region 510 and second end region 515 and second edge 520 having first end region 525 and second end region 530. Cable system 300 is shown with four cables each having a similar cable body 305 descending to rigid cover 500 on hot tub B. First cable 310 is shown with first cable end 315 affixed to first shaft 210 at first end region 215 and second cable end 320 affixed to first end region 510 of first edge 505 of rigid cover 500. Second cable 325 is shown with first cable end 330 affixed to first shaft 210 at second end region 220 and second cable end 335 affixed to second end region 515 of first edge 505 of rigid cover 500. Third cable 340 is shown with first cable end 345 affixed to second shaft 230 at first end region 235 and second cable end 350 affixed to first end region 525 of second edge 520 of rigid cover 500. Fourth cable 355 is shown with a first cable end 360 affixed to second shaft 230 at second end region 240 and second cable end 365 affixed to second end region 530 of second edge 520 of rigid cover 500.

Figure 3:
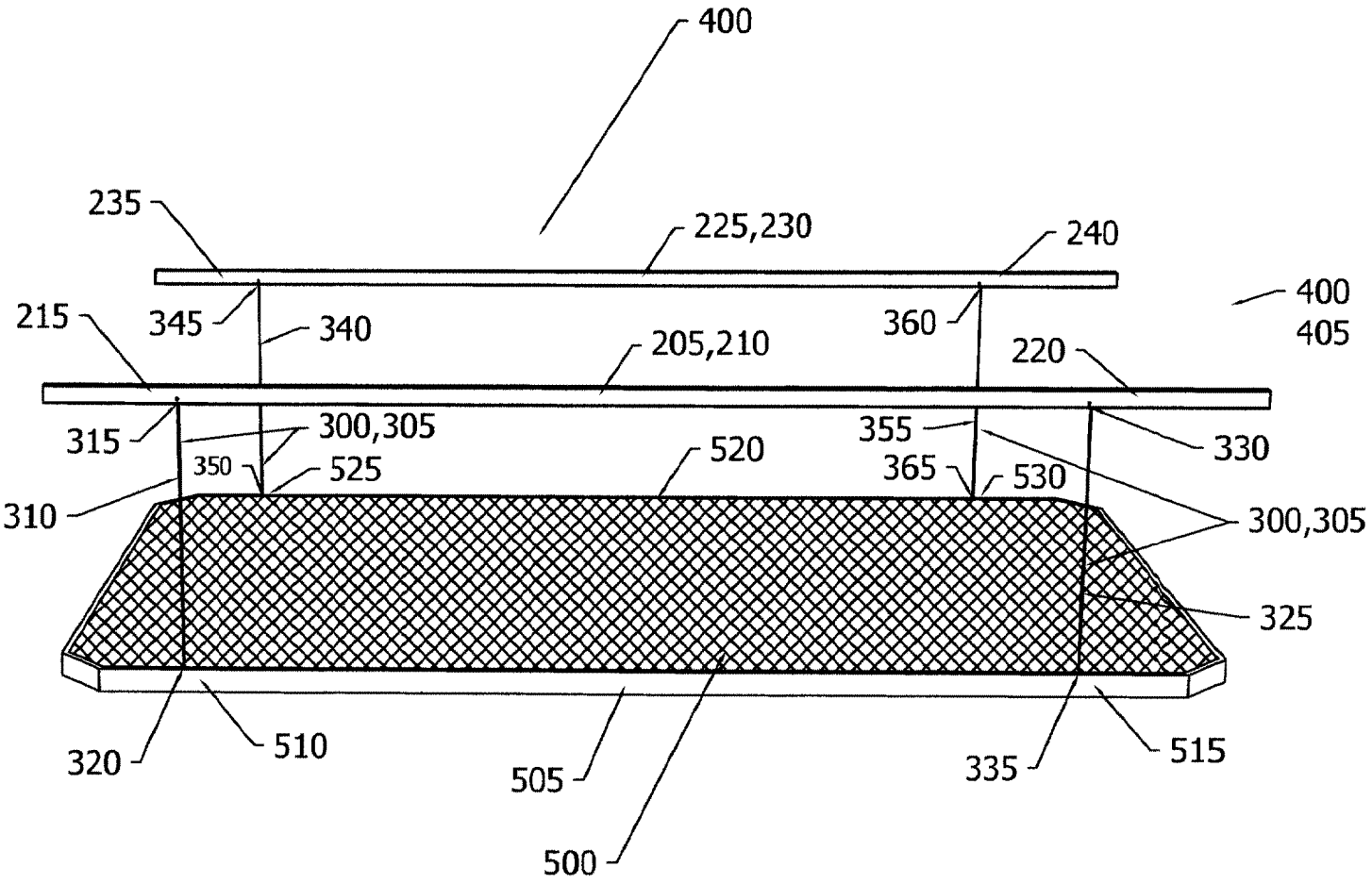
FIG. 3. is a side perspective view looking down of the hot tub cover hoist mechanism of FIG. 2 with the rigid cover in a mid-point position.

FIG. 3. is a side perspective view looking down of the hot tub cover hoist mechanism of FIG. 2 with the rigid cover in a mid-point position. The elements are shown with most clarity in this figure. Lift mechanism/direct drive lift 400 is shown with first housing 205 that contains first shaft 210 with first end region 215 and second end region 220 and second housing 225 that contain second shaft 230 with first end region 235 and second end region 240. Rigid cover 500 is shown with first edge 505 having first end region 510 and second end region 515 and second edge 520 having first end region 525 and second end region 530. Cable system 300 is shown with four cables each having a similar cable body 305 descending to rigid cover 500 on hot tub B. First cable 310 is shown with first cable end 315 affixed to first shaft 210 at first end region 215 and second cable end 320 affixed to first end region 510 of first edge 505 of rigid cover 500. Second cable 325 is shown with first cable end 330 affixed to first shaft 210 at second end region 220 and second cable end 335 affixed to second end region 515 of first edge 505 of rigid cover 500. Third cable 340 is shown with first cable end 345 affixed to second shaft 230 at first end region 235 and second cable end 350 affixed to first end region 525 of second edge 520 of rigid cover 500. Fourth cable 355 is shown with a first cable end 360 affixed to second shaft 230 at second end region 240 and second cable end 365 affixed to second end region 530 of second edge 520 of rigid cover 500.

Figure 4:
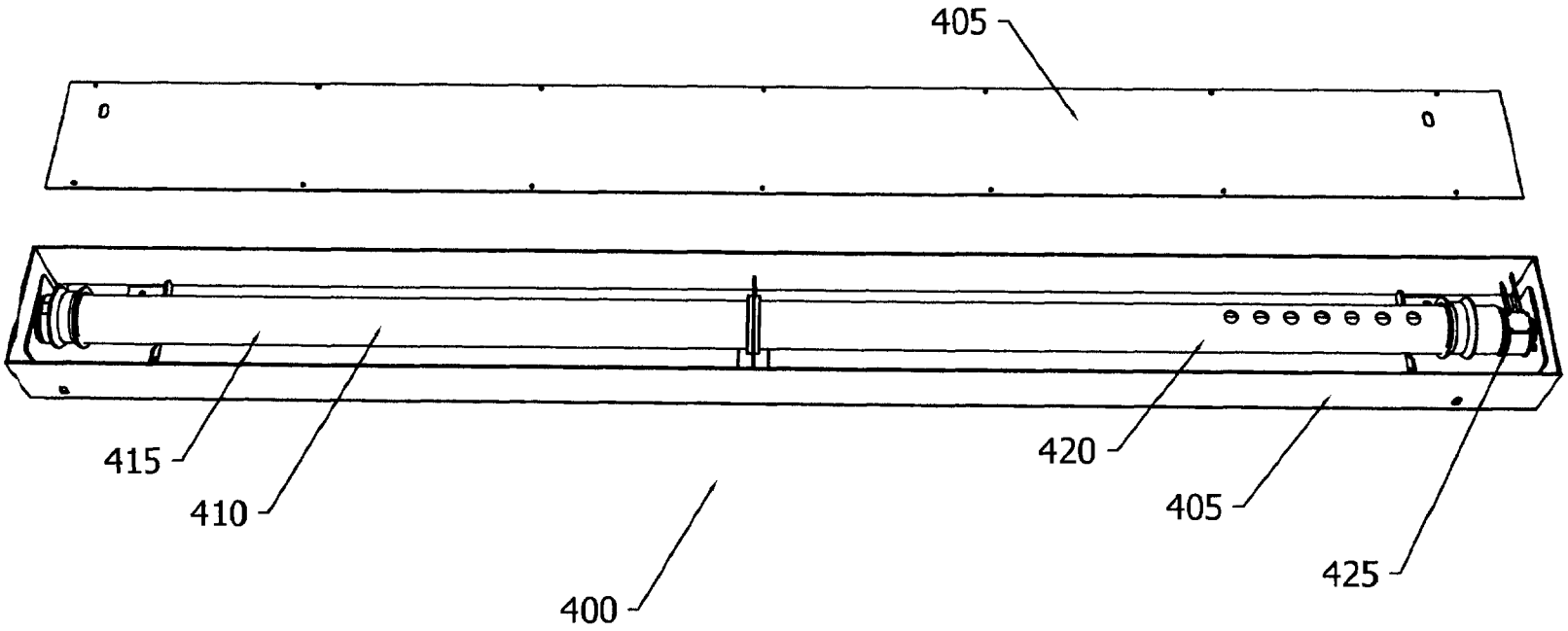
FIG. 4. is a side perspective view looking down of a holder with shaft/shaft and a means for rotating the shaft, a tubular motor.

FIG. 4. is a side perspective view looking down of a housing with a shaft and a means for rotating the shaft, a tubular motor. The powered shaft portion of lift mechanism/direct drive lift 400 is shown with a housing (405) split open and a shaft (210) inside. Shaft 410 has a first end region (415), a second end region (420), and a tubular motor (425) in communication with shaft 410 configured to rotate shaft 410.

Figure 5:
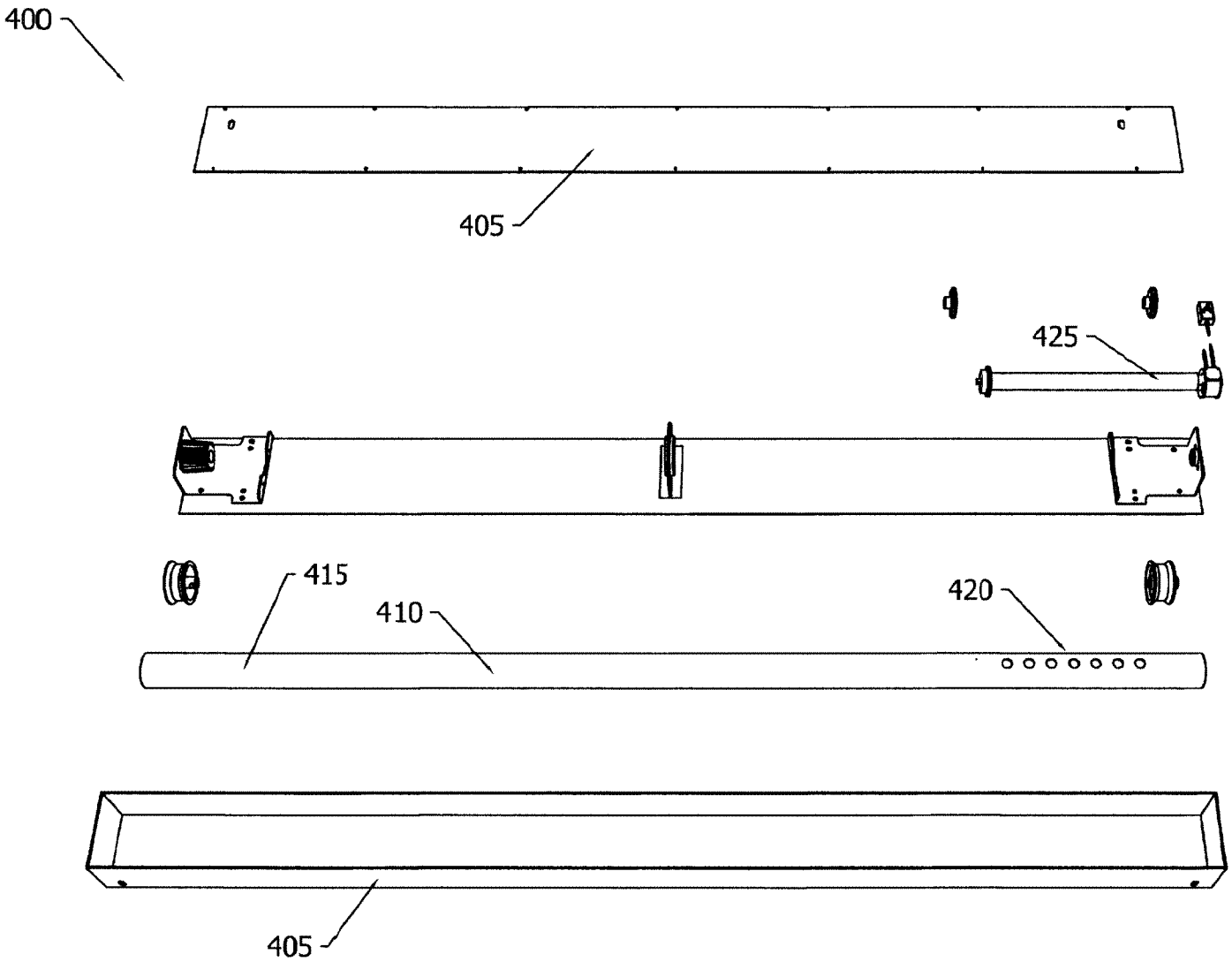
FIG. 5. is an exploded-perspective view of in the embodiment shown in FIG. 4.

FIG. 5. is an exploded perspective view of the embodiment shown in FIG. 4. The powered shaft portion of lift mechanism/direct drive lift 400 is shown with housing 405 split open and shaft 410 inside. Shaft 410 has first end region 415, second end region 420, and tubular motor 425 in communication with shaft 410 configured to rotate shaft 410.

Figure 6:
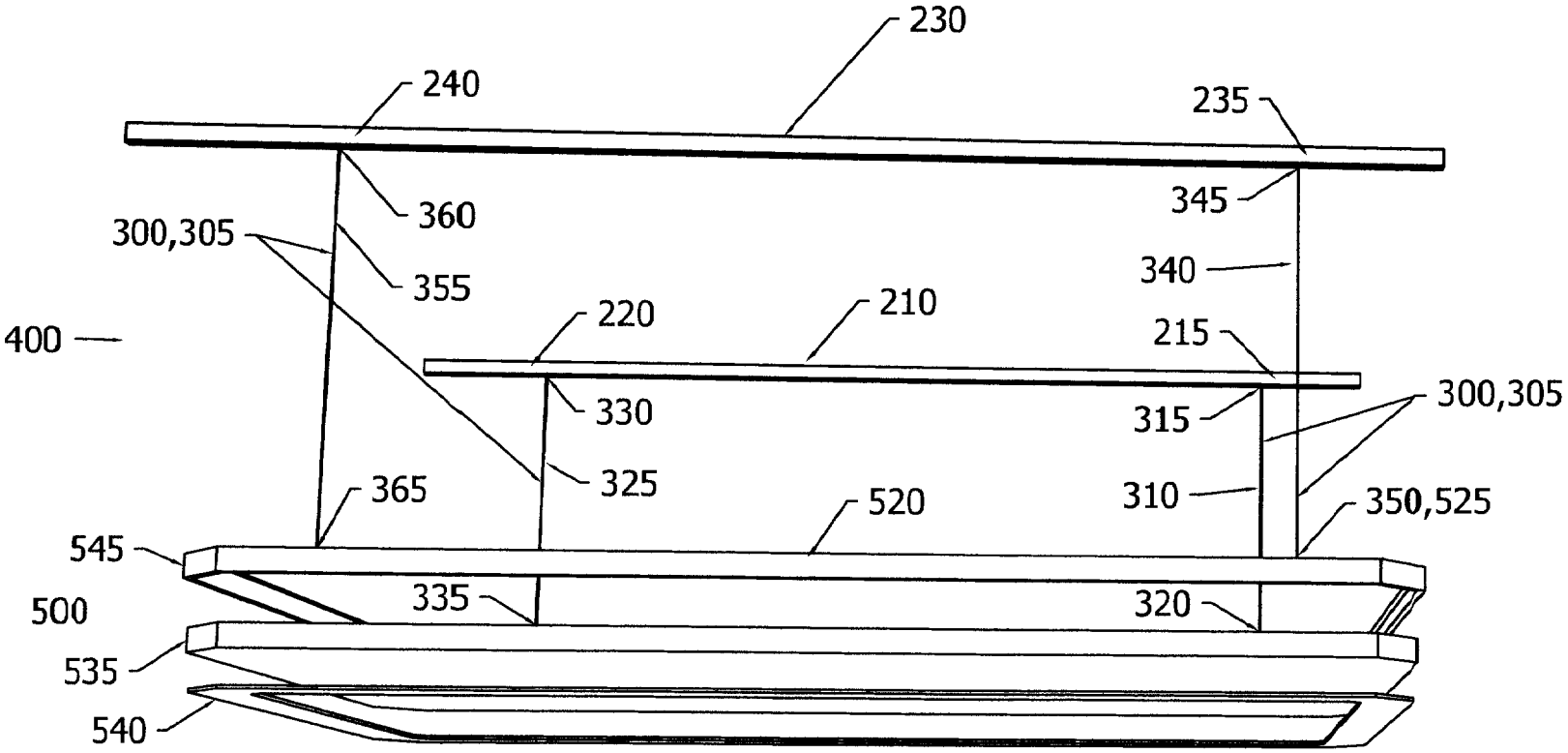
FIG. 6 is an exploded-perspective view looking behind and upward of the embodiment shown in FIG. 3.

FIG. 6 is an exploded perspective view looking behind and upward of the embodiment shown in FIG. 3. Lift mechanism/direct drive lift 400 is shown with first housing 205 that contains first shaft 210 with first end region 215 and second end region 220 and second housing 225 that contain second shaft 230 with first end region 235 and second end region 240. Rigid cover 500 is shown exploded into its three components, a factory cover (535), a factory cover frame (540), and a sturdy cover frame (545). Rigid cover 500 is shown with first edge 505 having first end region 510 and second end region 515 and second edge 520 having first end region 525 and second end region 530. Cable system 300 is shown with four cables each having a similar cable body 205 descending to rigid cover 500 on hot tub B. First cable 310 is shown with first cable end 315 affixed to first shaft 210 at first end region 215 and second cable end 320 affixed to first end region 510 of first edge 505 of rigid cover 500. Second cable 325 is shown with first cable end 330 affixed to first shaft 210 at second end region 220 and second cable end 335 affixed to second end region 515 of first edge 505 of rigid cover 500. Third cable 340 is shown with first cable end 345 affixed to second shaft 230 at first end region 235 and second cable end 350 affixed to first end region 525 of second edge 520 of rigid cover 500. Fourth cable 355 is shown with a first cable end 360 affixed to second shaft 230 at second end region 240 and second cable end 365 affixed to second end region 530 of second edge 520 of rigid cover 500.

FIG. 7 is a top exploded view of an embodiment of the hot tub cover hoist mechanism showing a means for turning the shaft, a shaft drive motor. The powered shaft portion of lift mechanism/direct drive lift 400 is shown with housing 405 split open and shaft 410 inside. Shaft 410 has first end region 415, second end region 420, and a pull chain motor 435 in communication with shaft 410 configured to rotate shaft 410.

FIG. 8 is an exploded perspective view looking downward of an embodiment of the hot tub cover hoist mechanism showing only the holder, shaft, and the means for turning the shaft, a pull chain drive assembly. The powered shaft portion of lift mechanism/direct drive lift 400 is shown with housing 405 split open and shaft 410 inside. Shaft 410 has first end region 415, second end region 420, and a shaft motor 430 in communication with shaft 410 configured to rotate shaft 410. Shaft 410 is shown in communication with a means for rotating shaft 435, in this case a direct drivel chain motor.

Figure 9:
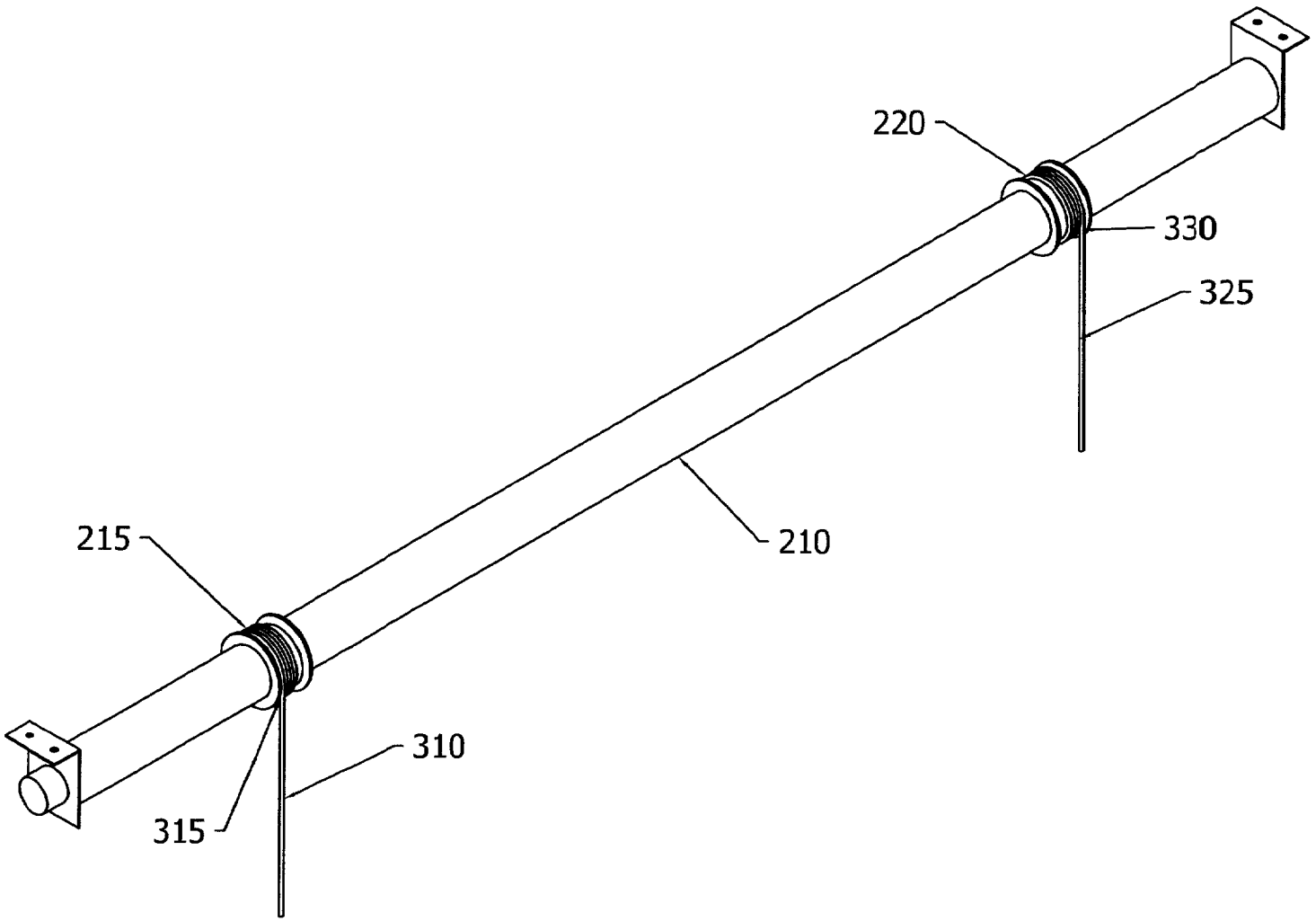
FIG. 9 is a perspective view of an embodiment of a hot tub cover hoist mechanism with a direct drive lift mechanism showing how the shaft with cables would wind about it.

FIG. 9 is a perspective view of an embodiment of a hot tub cover hoist mechanism with a direct drive lift mechanism showing how the shaft with cables would wind about it. This illustration is of the first shaft as shown in FIGS. 1-3 but applies for both shafts shown in those figures. First shaft 210 is shown with first end region 215 and second end region 220. First cable end 315 of first cable 310 is affixed to first end region 215 of first shaft 210 and shown partly wound about shaft 210 at this location. First cable end 330 of second cable 325 is affixed to second end region 220 of first shaft 210 and shown partly wound about shaft 210 at this location. The windings occur as the rigid cover (not shown) is raised.

Figure 10:
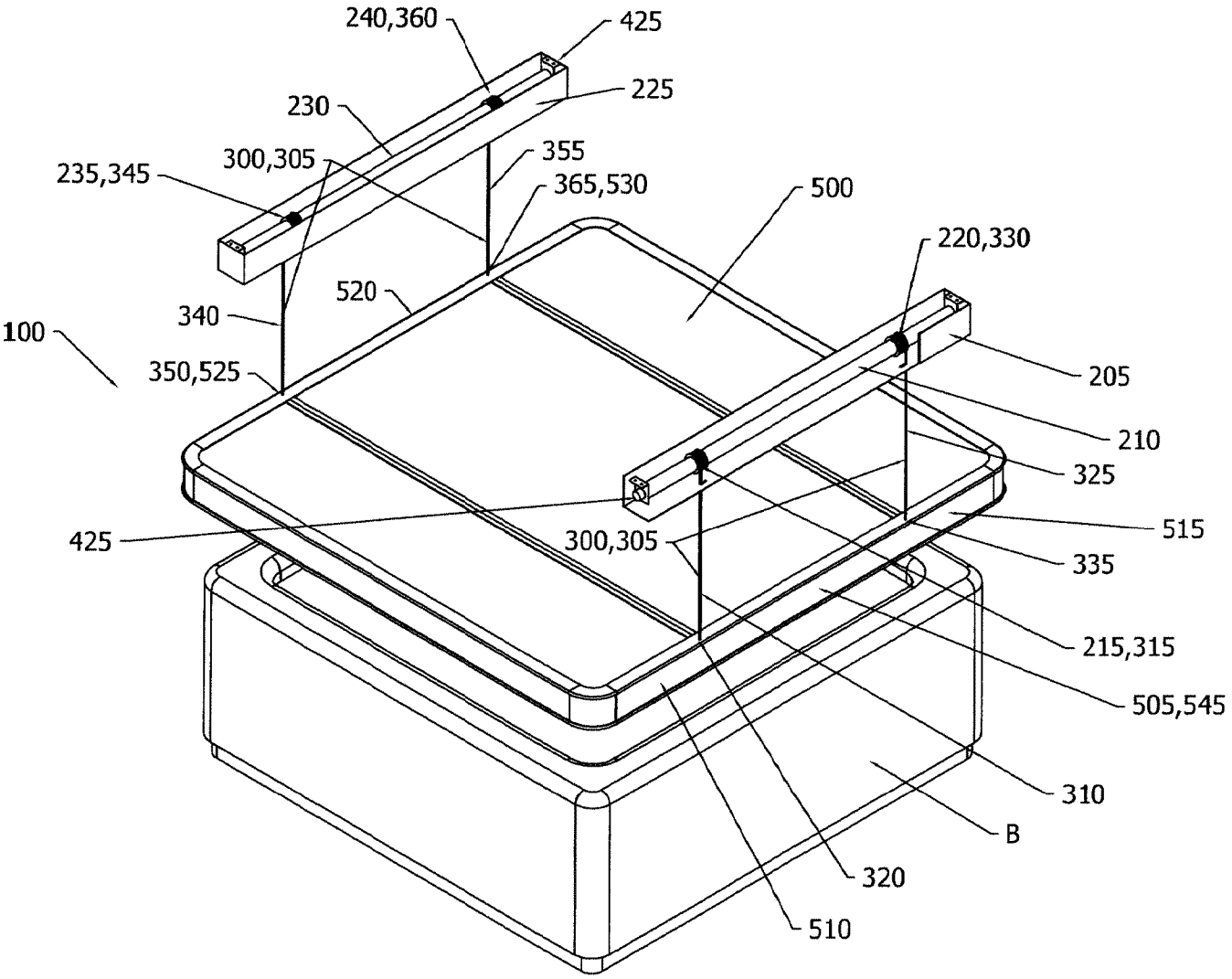
FIG. 10 is a perspective view looking downward on an embodiment of the hot tub cover hoist mechanism containing a direct drive lifting mechanism for a spa.

FIG. 10 is a perspective view looking downward on an embodiment of the hot tub cover hoist mechanism containing a direct drive lifting mechanism for a spa. Shown are two housings above hot tub B, the spa. Hot tub hoist mechanism 100 is shown with first housing 205 that contains first shaft 210 with first end region 215 and second end region 220 and second housing 225 that contain second shaft 230 with first end region 235 and second end region 240. Rigid cover 500 is shown with rigid frame 545 about folding cover panels, first edge 505 having first end region 510 and second end region 515 and second edge 520 having first end region 525 and second end region 530. Cable system 300 is shown with four cables each having a similar cable body 305 descending to rigid cover 500 on hot tub B. First cable 310 is shown with first cable end 315 affixed to first shaft 210 at first end region 215 and second cable end 320 affixed to first end region 510 of first edge 505 of rigid cover 500. Second cable 325 is shown with first cable end 330 affixed to first shaft 210 at second end region 220 and second cable end 335 affixed to second end region 515 of first edge 505 of rigid cover 500. Third cable 340 is shown with first cable end 345 affixed to second shaft 230 at first end region 235 and second cable end 350 affixed to first end region 525 of second edge 520 of rigid cover 500. Fourth cable 355 is shown with a first cable end 360 affixed to second shaft 230 at second end region 240 and second cable end 365 affixed to second end region 530 of second edge 520 of rigid cover 500. Lifting mechanism is a tubular motor 425 within each shaft to power rotation of the shafts and spool the four cables to raise rigid cover 500 shown partly raised above hot tub B.

Figure 11:
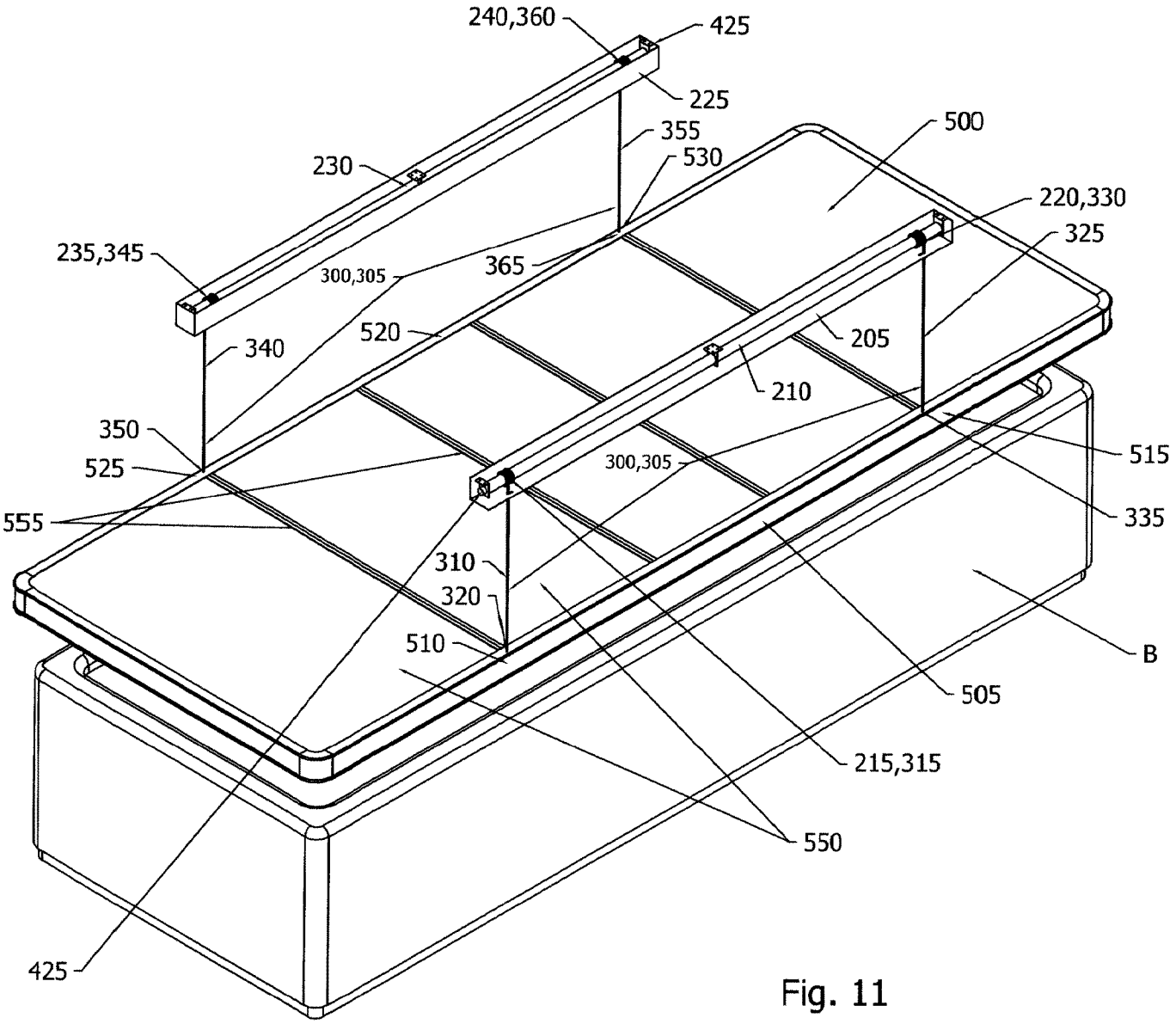
FIG. 11 is a perspective view looking downward on an embodiment of the hot tub cover hoist mechanism containing a direct drive lifting mechanism for a swim spa showing two housings, each with cables directed downward to opposite sides of a rigid cover.

FIG. 11 is a perspective view looking downward on an embodiment of the hot tub cover hoist mechanism containing a direct drive lifting mechanism for a swim spa showing two housings, each with cables directed downward to opposite long sides of a rigid cover. Shown are two housings 110 above hot tub B, the swimming spa. Hot tub hoist mechanism 100 is shown with first housing 205 that contains first shaft 210 with first end region 215 and second end region 220 and second housing 225 that contain second shaft 230 with first end region 235 and second end region 240. Rigid cover 500 is shown with rigid frame 545 about insulated foam cover panels 550 attached with cover panel connectors 555, first edge 505 having first end region 510 and second end region 515 and second edge 520 having first end region 525 and second end region 530. Cable system 300 is shown with four cables each having a similar cable body 305 descending to rigid cover 500 on hot tub B. First cable 310 is shown with first cable end 315 affixed to first shaft 210 at first end region 215 and second cable end 320 affixed to first end region 510 of first edge 505 of rigid cover 500. Second cable 325 is shown with first cable end 330 affixed to first shaft 210 at second end region 220 and second cable end 335 affixed to second end region 515 of first edge 505 of rigid cover 500. Third cable 340 is shown with first cable end 345 affixed to second shaft 230 at first end region 235 and second cable end 350 affixed to first end region 525 of second edge 520 of rigid cover 500. Fourth cable 355 is shown with a first cable end 360 affixed to second shaft 230 at second end region 240 and second cable end 365 affixed to second end region 530 of second edge 520 of rigid cover 500. Lifting mechanism is a tubular motor 425 within each shaft to power rotation of the shafts and spool the four cables to raise rigid cover 500 shown partly raised above hot tub B.

Figure 12:
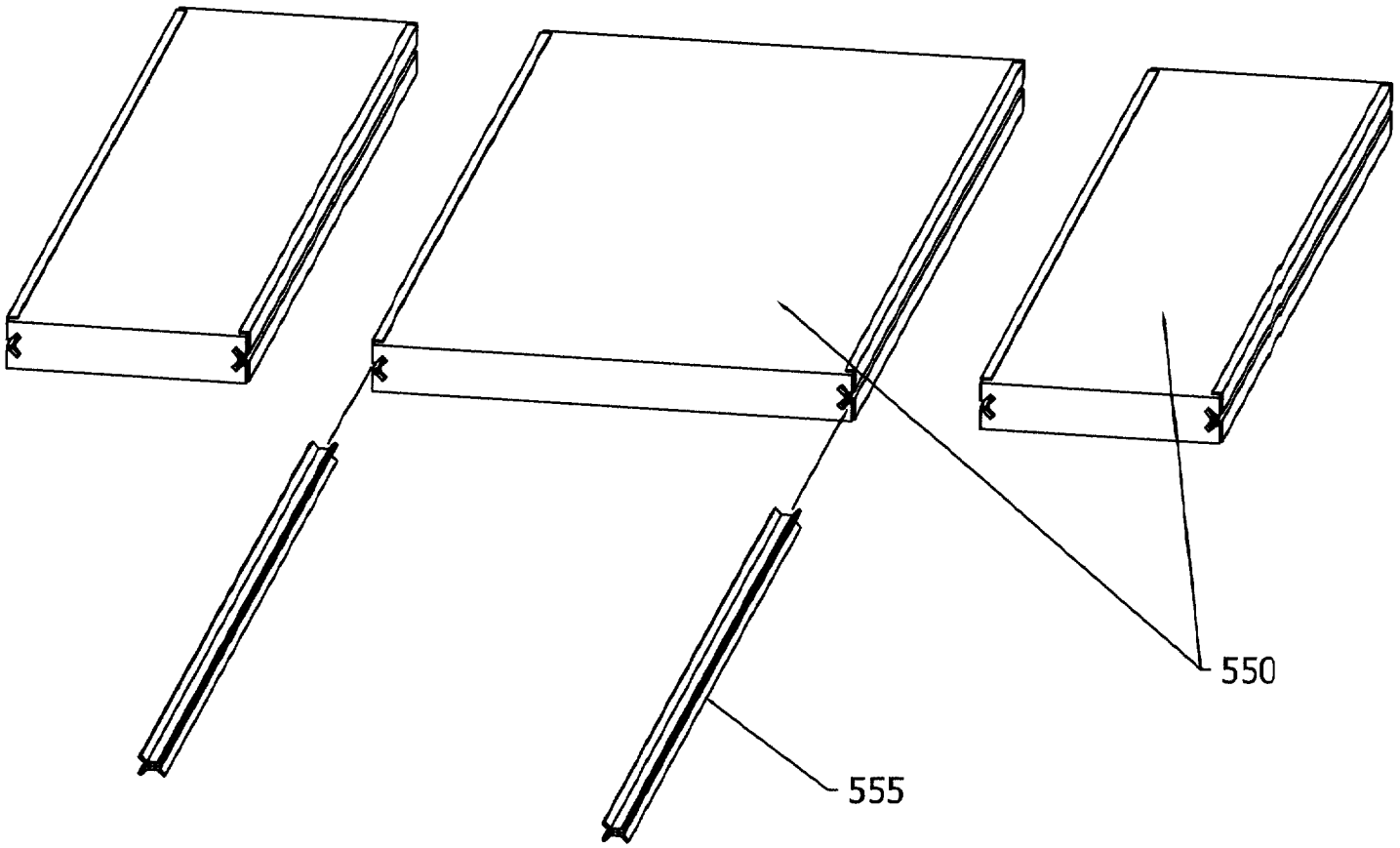
FIG. 12 is an exploded perspective view looking downward of elements of a rigid cover that is assembled from panels and connectors.
Figure 13A:
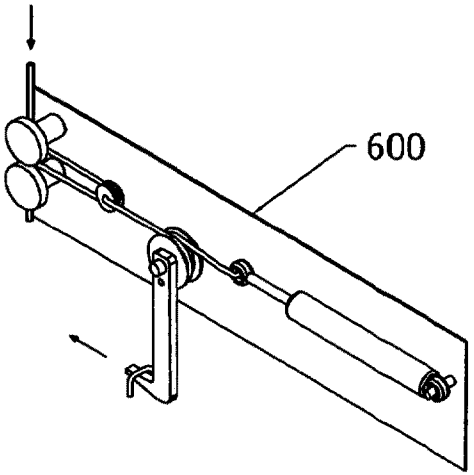
FIGS. 13A and 13B show a latch with a cable mechanism.
Figure 13B:
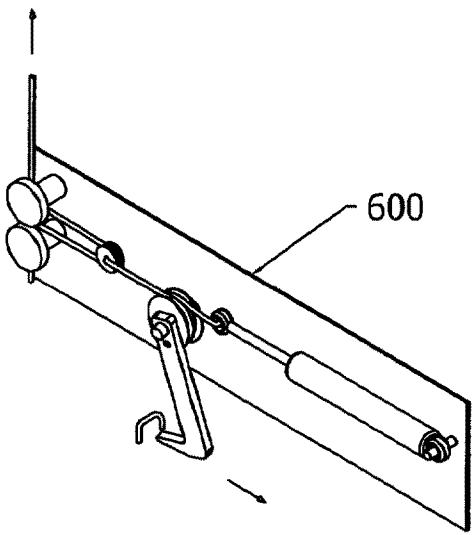
Figure 13C:
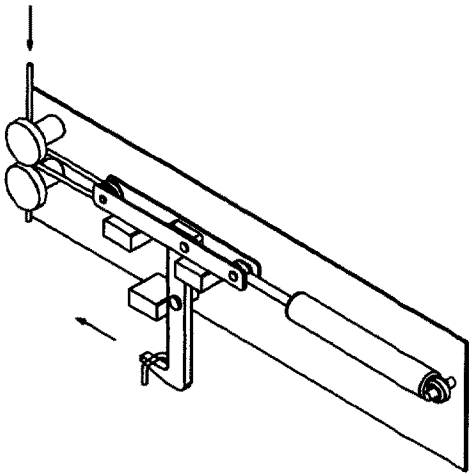
FIGS. 13C and 13D show a latch with a linkage mechanism.
Figure 13D:
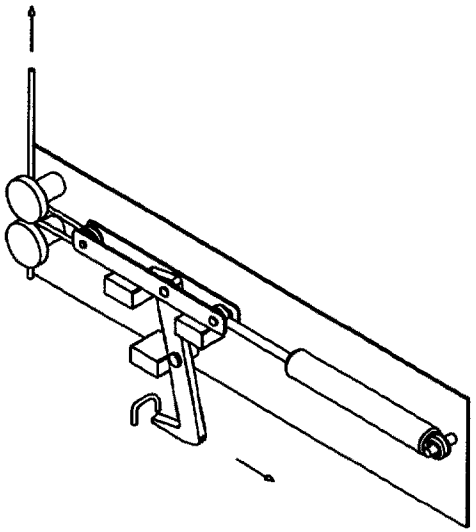

FIG. 12 is an exploded perspective view looking downward of elements of a rigid cover that is assembled from panels and connectors. Shown are insulated foam cover panels 550 and cover connectors 555.

FIG. 13 is a side perspective view of two views of two versions of a rigid cover latch in a locked and unlocked position. One version with a cable and pulley mechanism as shown in FIG. 13A and FIG. 13B. FIG. 13A shows this mechanism in a locked position in which the spring or shock is pulling the cable and causing the latch to rotate clockwise and latch on to the hook. FIG. 13B shows the cable and pulley mechanism in an unlocked position which occurs after the cable is pulled to lift the cover and the spring or shock is extended allowing the latch to rotate counterclockwise. A second linkage mechanism as shown in FIG. 13C and FIG. 13D. FIG. 13C shows this linkage mechanism in a locked position and FIG. 13D shows this linkage mechanism in an unlocked position. This mechanism is similar to the cable and pulley mechanism except the linkage mechanism slides left or right depending on the tension in the cable. The spring or shock serves the same function, and the latch rotates around a pivot point as the mechanism moves left or right.

Figure 14:
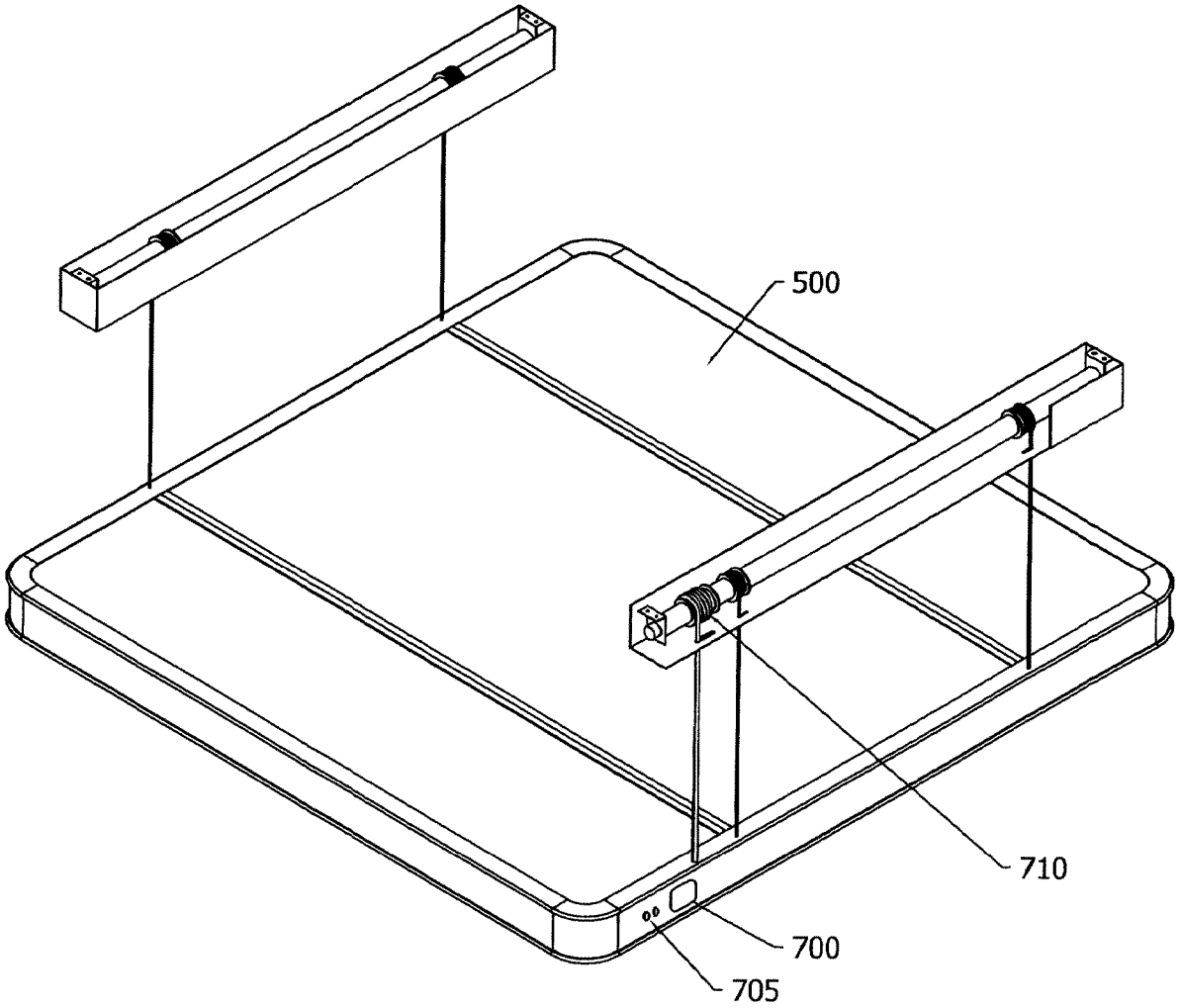
FIG. 14 is a perspective view looking downward on an embodiment of the hot tub cover hoist mechanism containing an accessory device direct drive lifting mechanism for a spa showing two housings, each with cables directed downward to opposite sides of a rigid cover. A power and/or control wire is shown supplying power to the rigid cover through a similar mechanism as used with the lifting cables. Power in the rigid cover provides for electrical operation of accessory controls and latch switches.

FIG. 14 is a perspective view looking downward on an embodiment of the hot tub cover hoist mechanism similar to the embodiment shown in FIG. 3 but accessory devices and just the rigid hot tub cover without the hot tub B. First end region 510 of first edge 510 shows a power cord (710) attached to the shaft and extending similar to the cables which provides power to the rigid cover for turning on accessory elements (700) such as lights (705) and a switch (720) (not shown).

FIG. 15 is a perspective view of a mechanism to keep tension on each cable (375) attached to each corner of the two shafts. This consists of two fixed ends (385) which are secured to the shaft and a center section (390) which rotates with springs or shocks (380) which provide tension on the cable depending on the force being applied to the cable and the allowed rotation of the center cable spooling section (390).

FIG. 16 is an exploded perspective view of the mechanism shown in FIG. 15 to keep tension on the cable attached to each shaft.

Figure 17B:
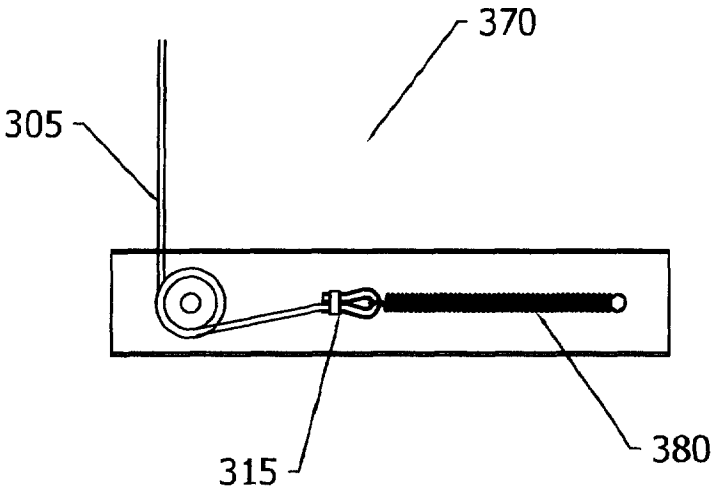
FIG. 17A shows the mechanism providing the tension on the cable when the cover is at rest and FIG. 17B shows the mechanism while the cover is being lifted.
Figure 17A:
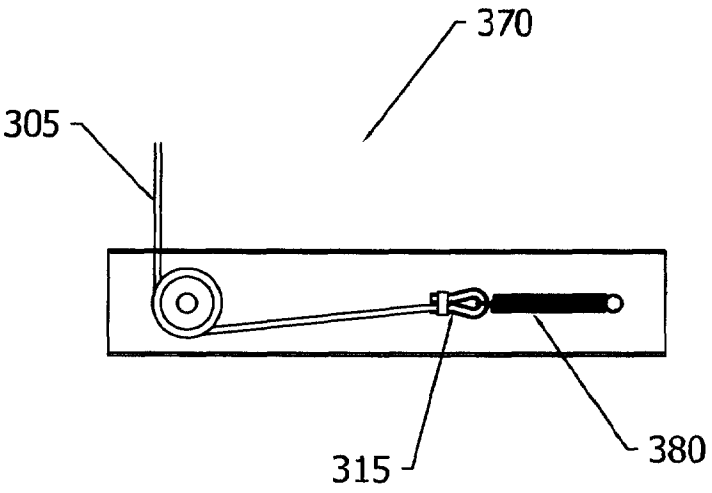

FIG. 17 is a front view of a mechanism to keep tension on each cable attached to the rigid cover (370). The cable (305) makes a 90 degree turn around a pulley and the cable end (315) is connected to a spring or shock (380) which will provide tension on the cable depending on the amount of force in the cable. FIG. 17A shows the shock or spring in its retracted state when the cover is at rest and is providing tension on the cable. FIG. 17B shows the condition with the cover being lifted and force exerted on the cable extending the shock or spring to its maximum extension.

FIG. 18 is a perspective view looking downward on an embodiment of the hot tub cover hoist mechanism similar to the embodiment shown in FIG. 10 but includes restraint devices and just the rigid hot tub cover without the hot tub B. The restraint device (800) is attached to the ceiling structure or the structure of the lifting mechanism (200). The first end of the restraint cable (805) is contained within the restraint device and the second end of the restraint cable (810) is connected to the cover next to the other cable system (300) on two corners.

FIG. 19 is a perspective view looking downward on an embodiment of the hot tub cover hoist mechanism similar to the embodiment shown in FIG. 10 but includes cable tension devices (375) connected to the corners of the two shafts and cable tension devices 370 connected to the rigid cover at the ends of each cable. Either one or the other or both devices may be employed to provide tension on the cable and prevent "birdsnest" unspooling of the cable.

The method aspect of operating step includes five steps. One step is to provide a hot tub under a structure with a ceiling. Another step is to provide a hot tub cover hoist mechanism comprising the four elements described above. Still another step is to affix the hot tub hoist mechanism to the ceiling and to the rigid cover. Another step is activating the lifting mechanism to turn the shaft to raise the rigid cover toward the ceiling to permit use of the hot tub. Still another is activating the lifting mechanism to turn the shaft to lower the rigid cover onto the hot tub when finished using the hot tub.

Operation by the end user is just a matter of unclipping, or detaching where latches are used, the rigid cover from the hot tub and then pushing the button and watching the rigid cover go up and down. The weight of the rigid cover is borne by the shaft in each housing. The cable attached to the rigid cover edge is connected to the shaft in the housing over that edge. The motor rotates the shaft to its preset start and stop points. Each cable is attached to the shaft above it, so the motors in communication with each shaft are equipped with a force sensor and stops pulling if the rigid cover is still locked. If the motors senses an obstruction it will reverse and set the rigid cover back down. These motors are on opposite sides above the rigid cover and provide easy access during installation and maintenance.

Unless otherwise defined, all technical and scientific terms used herein have the same meaning as commonly understood by one of ordinary skill in the art to which this invention belongs. Although methods and materials like or equivalent to those described herein can be used in the practice or testing of the cover hoist mechanism, suitable methods and materials are described above. All publications, patent applications, patents, and other references mentioned herein are incorporated by reference in their entirety to the extent allowed by applicable law and regulations. The cover hoist mechanism may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

I claim:

1. A hot tub cover hoist mechanism comprising:

an overhead mechanism configured to attach to a ceiling structure above a hot tub and comprising housings with shafts comprising at least a first housing and a second housing with the first housing comprising a first shaft with a first end region and a second end region, and the second housing comprising a second shaft with a first end region end and a second end region;

a system of cables comprising cables that comprise at least four cables with first cable ends and second cable ends where each cable comprises a body that extends vertically downward, and the four cables comprise (1) a first cable having the first cable end attached to the first end region of the first shaft and the second cable end attached to a rigid cover, (2) a second cable having the first cable end attached to the second end region of the first shaft and the second cable end attached to the rigid cover, (3) a third cable having the first cable end attached to the first end region of the second shaft and the second cable end attached to the rigid cover, and (4) a fourth cable having the first cable end attached to the second end region of the second shaft and the second cable end attached the rigid cover;

a lifting mechanism within the overhead mechanism comprising a direct drive lift in communication with at least the first shaft and the second shaft and the direct drive lift (1) is in communication with the first cable ends, (2) is configured to exert a vertical first force through the cables, and (3) is configured to turn the first shaft and the second shaft to rotate the first shaft and the second shaft in a first direction and a second direction in synchronized movement to lift and lower the second ends in unison;

the rigid cover having a weight with a vertical second force that is not more than the vertical first force from the direct drive lift through the cables, in communication with the second ends of the cables, and comprising (1) a first edge with a first end region attached to the second cable end of the first cable and a second end region attached to the second cable end of the second cable and (2) a second edge parallel to the first edge and with a first end region attached to the second cable end of the third cable and a second end region attached to the second cable end of the fourth cable that are configured to distribute the weight and the vertical second force of the rigid cover equally when the cables are under tension; and a cable-tensioning mechanism attached to each cable and configured to maintain each cable under tension when the rigid hot tub cover is resting on the hot tub.

2. A hot tub cover hoist mechanism of claim 1 wherein the direct drive lift for turning the shaft in each housing is a motor in each housing in communication with the shaft in the housing, having a torque of at least half of the weight of the rigid cover, and configured to wind the cables simultaneously about the shafts to lift the rigid cover and lower the rigid cover.

3. A hot tub cover hoist mechanism of claim 1 wherein the first force equals the second force and the direct drive lift for turning the shaft is a hand crank or pull chain-drawing direct drive lift to move the cable over the shaft above the rigid cover.

4. A hot tub cover hoist mechanism of claim 1 wherein the cable-tensioning mechanism is attached to each cable and to the rigid cover proximate where each cable is used to lift and lower the rigid cover.

5. A hot tub cover hoist mechanism of claim 1 wherein the cable-tensioning mechanism is attached to each cable and to each shaft proximate where each cable is used to lift and lower the rigid cover.

6. A hot tub cover hoist mechanism of claim 1 comprising a safety device to prevent accidental lowering of the rigid cover in the event of a component failure.

7. A hot tub cover hoist mechanism of claim 1 further comprising latches incorporated into the lifting mechanism so that the rigid cover is automatically secured after being lowered, to prevent unintentional access or loss of the rigid cover due to external forces, and then automatically released once the rigid cover is lifted.

8. A hot tub cover hoist mechanism of claim 1 further comprising an accessory device comprising, power and control wires in communication with the rigid cover along the cables and configured to create powered features, lights, speakers, controls, and motors to actuate latches in the rigid cover.

9. A hot tub cover hoist mechanism of claim 1 wherein the rigid cover is a factory cover with a frame, the factory cover has at least one fold, and the frame comprises shafts or channels affixed to form a framed cover that is rigid enough to be lifted by the hot tub cover hoisting mechanism without adversely folding of the rigid cover.

10. A hot tub cover hoist mechanism of claim 1 wherein the rigid cover is a factory cover, a factory cover with a frame, or a nested group of insulated panels within a frame and the nested group of insulated panels within the frame and the insulated panels are of varying widths that are configured to interconnect to create a rigid cover that is the proper length for the hot tub and is rigid enough to be lifted by the hot tub cover hoisting mechanism without adversely folding.

11. A method of using a hot tub hoist mechanism comprising the steps of, providing a hot tub under a ceiling of a structure;

providing a hot tub cover hoist mechanism comprising an overhead mechanism configured to attach to—the ceiling of the structure above the hot tub and comprising housings with shafts comprising at least a first housing and a second housing with the first housing comprising a first shaft with a first end region and a second end region, and the second housing comprising a second shaft with a first end region end and a second end region;

a system of cables comprising cables that comprise at least four cables with first cable ends and second cable ends where each cable comprises a body that extends vertically downward, and the four cables comprises (1) a first cable having the first cable end attached to the first end region of the first shaft and the second cable end attached to a rigid cover, (2) a second cable having the first cable end attached to the second end region of the first shaft and the second cable end attached to the rigid cover, (3) a third cable having the first cable end attached to the first end region of the second shaft and the second cable end attached to the rigid cover, and (4) a fourth cable having the first cable end attached to the second end region of the second shaft and the second cable end attached the rigid cover;

a lifting mechanism within the overhead mechanism comprising a direct drive lift in communication with at least the first shaft and the second shaft and the direct drive lift (1) is in communication with the first cable ends, (2) is configured to exert a vertical first force through the cables, and (3) is configured to turn the first shaft and the second shaft to rotate the first shaft and the second shaft in a first direction and a second direction in synchronized movement to lift and lower the second ends in unison;

the rigid cover having a weight with a vertical second force that is not more than the vertical first force from the direct drive lift through the cables, in communication with the second ends of the cables, and comprising (1) a first edge with a first end region attached to the second cable end of the first cable and a second end region attached to the second cable end of the second cable and (2) a second edge parallel to the first edge and with a first end region attached to the second cable end of the third cable and a second end region attached to the second cable end of the fourth cable that are configured to distribute the weight and the vertical second force of the rigid cover equally when the cables are under tension; and a cable-tensioning mechanism attached to each cable and configured to maintain each cable under tension when the rigid hot tub cover is resting on the hot tub;

affixing the hot tub hoist mechanism to the ceiling and to the rigid cover, activating the lifting mechanism to turn the shaft to raise the rigid cover toward the ceiling to permit use of the hot tub, and activating the lifting mechanism to turn the shaft to lower the rigid cover onto the hot tub when finished using the hot tub without any cable not under tension to avoid slack.

12. The method of using a hot tub hoist mechanism of claim 11 wherein direct drive lift for turning the first shaft in the first housing and the second shaft in the second housing is a first motor in the first housing in communication with the first shaft and a second motor in the second housing in communication with the second shaft, wherein the first motor and the second motor each have a torque of at least half of the weight of the rigid cover, and are configured to wind the cables simultaneously about the first shaft and the second shaft to lift the rigid cover and lower the rigid cover.

13. The method of using a hot tub hoist mechanism of claim 11 wherein the direct drive lift for turning the first shaft in the first housing and the second shaft in the second housing is a first motor in the first housing in communication with the first shaft and a second motor in the second housing in communication with the second shaft and having a combined torque of at least the weight of the rigid cover to wind the four cables simultaneously about the first shaft and the second shaft to lift the rigid cover and lower the rigid cover.

14. The method of using a hot tub hoist mechanism of claim 11 wherein the cable-tensioning mechanism is attached to each cable and to the rigid cover proximate where each cable is used to lift and lower the rigid cover.

15. The method of using a hot tub hoist mechanism of claim 11 wherein the cable-tensioning mechanism is attached to each cable and to each shaft proximate where each cable is used to lift and lower the rigid cover.

16. The method of using a hot tub hoist mechanism of claim 11 further comprising a safety device to prevent accidental lowering of the rigid cover in the event of a component failure.

17. The method of using a hot tub hoist mechanism of claim 11 further comprising the steps of, providing latches incorporated into the lifting mechanism so that the rigid cover is automatically secured after being lowered, to prevent unintentional access or loss of the rigid cover due to external forces, and then automatically released once the rigid cover is lifted;

unlatching the lifting mechanism to permit the rigid cover to be raised toward the ceiling; and latching the lifting mechanism after the rigid cover is lowered onto the hot tub to prevent unintentional access or loss of the rigid cover due to external forces.

18. The method of using a hot tub hoist mechanism of claim 11 further comprising the steps of, providing accessory devices comprising, power and control wires in communication with the rigid cover along the cables and configured to create powered features, lights, speakers, controls, and motors to actuate latches in the rigid cover, and a controller that uses a keyed, non-keyed, mounted, or handheld switch to activate the lifting mechanism to lift or lower the rigid cover, and using the features as desired.

* * * * *